US006385423B1

(12) United States Patent
Kai

(10) Patent No.: US 6,385,423 B1
(45) Date of Patent: May 7, 2002

(54) IMAGE FORMING APPARATUS AND DEVELOPING DEVICE THEREFOR CAPABLE OF INCREASING IMAGE DENSITY OF A LOW CONTRAST IMAGE

(75) Inventor: Tsukuru Kai, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/505,715

(22) Filed: Feb. 17, 2000

(30) Foreign Application Priority Data

Feb. 17, 1999 (JP) ..... 11-039198
Jun. 2, 1999 (JP) ..... 11-155378
Feb. 7, 2000 (JP) ..... 2000-029637

(51) Int. Cl.[7] ..... G03G 15/09
(52) U.S. Cl. ..... 399/277
(58) Field of Search ..... 399/252, 265, 399/267, 275, 276, 277, 279, 281, 282, 286; 492/8; 430/108, 111

(56) References Cited

U.S. PATENT DOCUMENTS 4,941,019 A 7/1990 Honda et al. ..... 399/275
5,255,059 A 10/1993 Kai et al. ..... 399/265
5,323,214 A 6/1994 Kai ..... 399/289
5,359,397 A 10/1994 Yamaji ..... 399/277
5,396,026 A * 3/1995 Sato et al. ..... 399/276
5,424,489 A * 6/1995 Sato et al. ..... 399/276
5,525,752 A * 6/1996 Izumizaki et al. ..... 399/275
5,970,280 A 10/1999 Suzuki et al. ..... 399/55
5,999,762 A 12/1999 Shoji ..... 399/55
6,021,296 A * 2/2000 Tamura et al. ..... 399/277
6,041,207 A * 3/2000 Ishiguro et al. ..... 399/275

FOREIGN PATENT DOCUMENTS

| | | |
|---|---|---|
| JP | 05040410 | 8/1991 |
| JP | 5-303284 | 11/1993 |
| JP | 06019321 | 1/1994 |
| JP | 6-110333 | 4/1994 |
| JP | 6-149058 | 5/1994 |
| JP | 7-117791 | 12/1995 |
| JP | 9-43992 | 2/1997 |
| JP | 2881823 | 2/1999 |

OTHER PUBLICATIONS

Patent Abstracts of Japan, vol. 018, No. 121 (P–1700), Feb. 25, 1994, JP 05 307297, Nov. 19, 1993.

* cited by examiner

*Primary Examiner*—Arthur T. Grimley
*Assistant Examiner*—Hoan Tran
(74) *Attorney, Agent, or Firm*—Oblon, Spivak, McClelland, Maier & Neustadt, P.C.

(57) ABSTRACT

In an image forming apparatus, the rise and fall of a short magnet brush are realized and allow a nip for development to be reduced. This, coupled with the fact that the short magnet brush uniformly rises and falls in the axial direction of a developing sleeve, frees the trailing edge of an image from local omission or jaggedness while reducing defective images including a thinned dot image.

60 Claims, 19 Drawing Sheets

INVENTION

*Fig. 13*

φ 16mm (FeNdB BOND ROLLER OF THE INVENTION)

| | P1a | P1b | P1c | P2 | P3 | P4 | P5 | P6 |
|---|---|---|---|---|---|---|---|---|
| FLUX DENSITY (mT) | 62.9 | 63.8 | 78.7 | 63.6 | – | 48.1 | 64.6 | 60.0 |
| HALF CENTER ANGLE | 334.1 (25.8) | 0 | 27.5 | 67.1 | – | 151.5 | 212.7 | 279.2 |
| HALF-WIDTH | 19.7 | 17.0 | 19.7 | 30.6 | – | 28.0 | 52.2 | 37.7 |
| POLARITY | N | S | N | S | | S | N | S |

φ 16mm (PRIOR ART ROLLER)

| | P1 | P2 | P3 | P4 | P5 | P6 |
|---|---|---|---|---|---|---|
| FLUX DENSITY (mT) | 75.4 | 57.2 | – | 44.1 | 57.7 | 50.7 |
| HALF CENTER ANGLE | 0 | 69.5 | – | 153.2 | 220.6 | 297.0 |
| HALF-WIDTH | 45.3 | 45.2 | – | 34.3 | 52.5 | 41.56 |
| POLARITY | N | S | | S | N | S |

φ 20mm (FeNdB BOND ROLLER OF THE INVENTION)

| | P1a | P1b | P1c | P2 | P3 | P4 | P5 | P6 |
|---|---|---|---|---|---|---|---|---|
| FLUX DENSITY (mT) | 87.0 | 69.8 | 77.7 | 54.0 | – | 30.0 | 72.8 | 62.2 |
| HALF CENTER ANGLE | 337.7 (−22.3) | 0 | 22.6 | 59.1 | – | 147.8 | 203.0 | 287.6 |
| HALF-WIDTH | 17.8 | 13.4 | 17.1 | 29.7 | – | 84.9 | 42.2 | 46.6 |
| POLARITY | S | N | S | N | | N | S | N |

φ 20mm (PRIOR ART ROLLER)

| | P1 | P2 | P3 | P4 | P5 | P6 |
|---|---|---|---|---|---|---|
| FLUX DENSITY (mT) | 89.2 | 57.5 | – | 21.1 | 63.5 | 71.9 |
| HALF CENTER ANGLE | 0 | 65.8 | – | 157.8 | 211.4 | 295.5 |
| HALF-WIDTH | 47.6 | 37.2 | – | 29.3 | 38.0 | 49.7 |
| POLARITY | N | S | | S | N | S |

Fig. 21

φ30mm (FeNdB BOND ROLLER OF THE INVENTION)

| | P1a | P1b | P1c | P2 | P3 | P4 | P5 | P6 | P7 | P8 |
|---|---|---|---|---|---|---|---|---|---|---|
| FLUX DENSITY (mT) | 92.7 | 93.2 | 90.0 | 69.4 | – | 50.0 | 54.7 | 48.5 | 85.8 | 63.6 |
| HALF CENTER ANGLE | 345 (−15.0) | 0 | 15.6 | 60.1 | – | 140.6 | 185.7 | 220.7 | 272.3 | 311.5 |
| HALF-WIDTH | 11.6 | 9.7 | 12.1 | 24.3 | – | 26.5 | 25.9 | 20.8 | 27.2 | 19.0 |
| POLARITY | S | N | S | N | | N | S | N | S | N |

φ30mm (PRIOR ART ROLLER)

| | P1 | P2 | P3 | P4 | P5 | P6 | P7 |
|---|---|---|---|---|---|---|---|
| FLUX DENSITY (mT) | 102.3 | 64.6 | – | 61.8 | 54.7 | 46.3 | 79.7 |
| HALF CENTER ANGLE | 0 | 56.5 | – | 138.7 | 185.0 | 222.6 | 270.9 |
| HALF-WIDTH | 27.8 | 23.3 | – | 23.6 | 23.8 | 26.3 | 24.8 |
| POLARITY | N | S | | S | N | S | N |

IMAGE FORMING APPARATUS AND DEVELOPING DEVICE THEREFOR CAPABLE OF INCREASING IMAGE DENSITY OF A LOW CONTRAST IMAGE

BACKGROUND OF THE INVENTION

The present invention relates to an image forming apparatus and more particularly to a developing device therefore capable of increasing image density and improving the quality of a low contrast image.

It is a common practice with a copier, printer, facsimile apparatus or similar electrophotographic or electrostatic image forming apparatus to electrostatically form a latent image on an image carrier in accordance with image data. The image carrier may be implemented by a photoconductive element or a photoconductive belt. A developing device develops the latent image with toner and thereby produces a corresponding toner image. A current trend in the imaging art is toward a magnet brush type developing system using a toner and carrier mixture or two-ingredient type developer. This type of developing system is desirable from the standpoint of image transfer, halftone reproducibility, and stability of development against varying temperature and humidity. Specifically, a developing device using this type of system causes the developer to rise in the form of a brush chain on a developer carrier, so that toner contained in the developer is transferred to a latent image formed on the image carrier at a developing region. The developing region refers to a range over which a magnet brush rises on a developer carrier and contents the image carrier.

The developer carrier is generally made up of a hollow cylindrical sleeve or developing sleeve and a magnet roller surrounded by the sleeve. The magnet roller forms a magnetic field for causing the developer deposited on the sleeve to rise in the form of a head. When the developer rises on the sleeve, carrier particles contained therein rise along magnetic lines of force generated by the magnet roller. Charged toner particles are deposited on each of such carrier particles. The magnet roller has a plurality of magnetic poles formed by rod-line magnetic and including a main magnetic pole for causing the developer to rise in the developing region.

In the above configuration, when at least one of the sleeve and magnet roller moves, it conveys the developer forming a head thereon. The developer brought to the developing region rises in the form of a brush chain along the magnetic lines of force generated by the main magnetic pole. The brush chain or head contacts the surface of the image carrier while yielding itself. While the brush chain or head sequentially rubs itself against a latent image formed on the image carrier on the basis of a difference in linear velocity between the developer carrier and the sleeve, the toner is transferred from the developer carrier to the image carrier.

The problem with the above developing device is that conditions for increasing image density and conditions for desirably developing a low contrast are contrary to each other. It is therefore difficult to improve both of a high density portion and a low density portion at a time. Specifically, the conditions for increasing image density are, e.g., that a gap for development between the image carrier and the sleeve be small and that the developing region be broad. Conversely, the conditions for desirably developing a low contrast image are, e.g., that the above gap be great and that the above developing region be narrow. Therefore, implementing high image quality by satisfying both of the above two different conditions is difficult to practice, as generally accepted.

Particularly, when importance is attached to a low contrast image, it is likely that the crossing portion of solid line images or the trailing edge of a solid black or halftone image is jagged or locally lost. It is also likely that a lattice image formed with the same width has horizontal lines developed thinner than vertical lines or that a solitary dot or similar small dot image is not developed at all.

Technologies relating to the present invention are disclosed in, e.g., Japanese Patent Laid-Open Publication Nos. 5-303284, 6-110333, 6-149058 and 9-43992, Japanese Publication No. 7-117791, and Japanese Patent No. 2,881,823.

SUMMARY OF THE INVENTION

It is therefore an object of the present invention to provide an image forming apparatus capable o obviating the jaggedness or local omission of the trailing edge of an image, particularly a low contrast image, for thereby insuring desirable image density and image quality, and a developing device therefor.

In accordance with the present invention, in a method of developing a latent image electrostatically formed on an image carrier by causing a developer to deposit on a developing sleeve in the form of a magnet brush and contact the image carrier, the magnet brush uniformly rises in the form of a head in the axial direction of the developing sleeve and contacts the image carrier.

Also, in accordance with the present invention, in a developing device for developing a latent image electrostatically formed on an image carrier by causing a developer to deposit on a developing sleeve in the form of a magnet brush and contact the image carrier, the magnet brush uniformly rises in the form of a head in the axial direction of the developing sleeve and contacts the image carrier.

Further, in accordance with the present invention, in a magnet roller constituting a developer carrier mounted on a developing device, an auxiliary magnet helps the main magnetic pole form a magnetic force for causing a developer to rise in the form of a head in a preselected developing region.

Moreover, in accordance with the present invention, in an image forming apparatus including a developing device for developing a latent image electrostatically formed on an image carrier by causing a developer to deposit on a developing sleeve in the form of a magnet brush and contact the image carrier, the magnet brush uniformly rises in the form of a head in the axial direction of the developing sleeve and contacts the image carrier.

BRIEF DESCRIPTION OF THE DRAWINGS

The above and other objects, features and advantages of the present invention will become more apparent from the following detailed description taken with the accompanying drawings in which:

FIG. 13 shows tables comparing the present invention and prior art with respect to some different factors of a magnet roller;

FIG. 21 shows tables comparing the present invention and prior at with respect to some different factors of a magnet roller.

DESCRIPTION OF THE PREFERRED EMBODIMENTS

Figure 1:
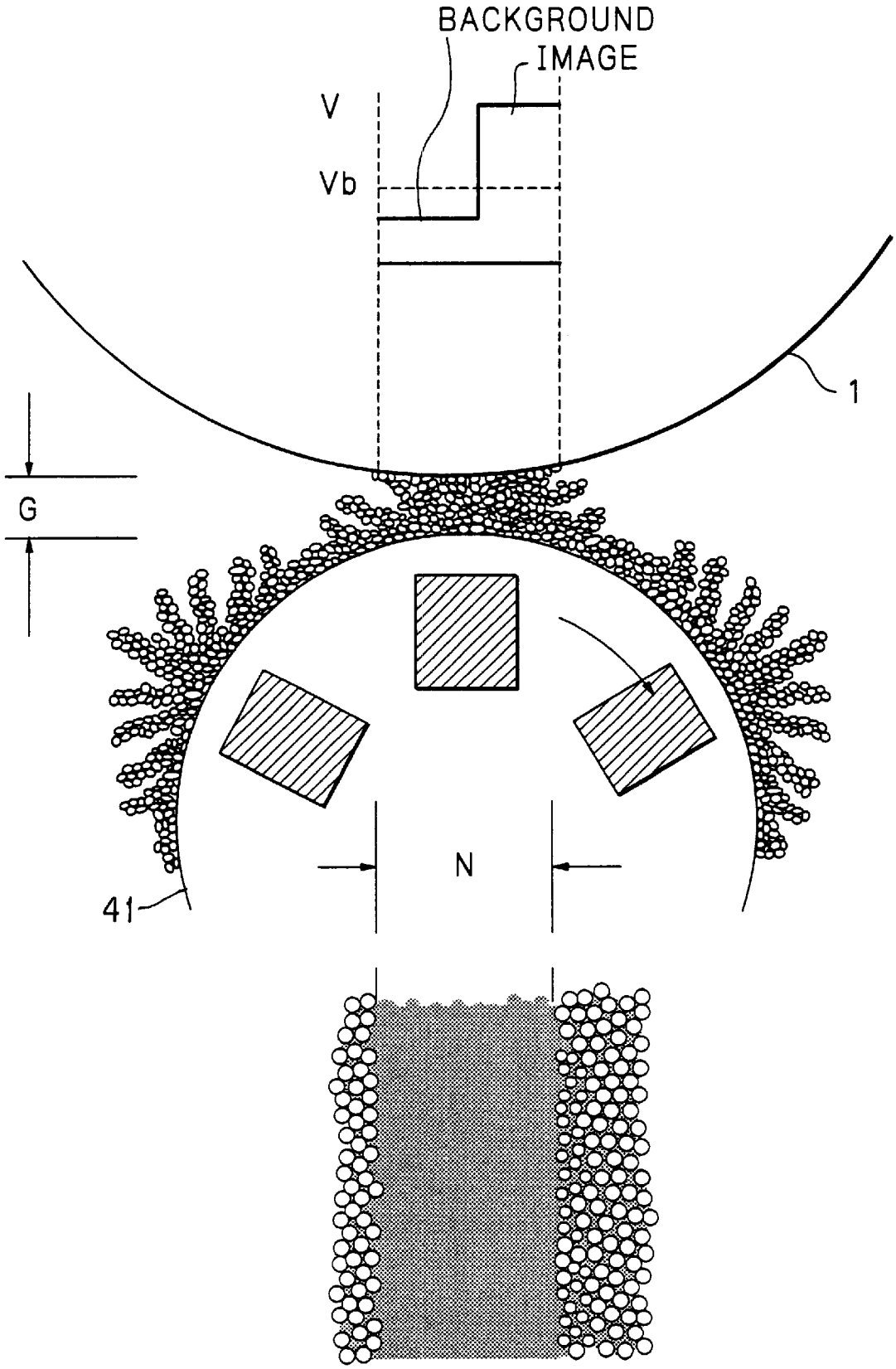
Fig. 1 PRIOR ART
FIG. 1 is a view for describing why the trailing edge of an image is jagged or locally lost.

To better understand the present invention, reference will be made to conventional technologies and problem thereof. First while the trailing edge of a toner image is appears jagged due to local omission will be described with reference to FIG. 1. As shown, a magnet brush is formed on a sleeve 41 and contacts an image carrier 1 at a nip N for development. The jagged trailing edge of an image is asoribable to a difference between the linear velocity of the image carrier 1 and that of the sleeve 41 (ratio of the linear velocity of the sleeve 41 to that of the image carrier 1) as measured at the nip N. For example, when the above ratio is 2.5, the sleeve 41 moves at a speed 2.5 times as high as the speed of the image carrier 1. When a magnet accommodated in the sleeve 41 had a main pole half-width of 48°, the nip N and a gap 8 for development were respectively about 4 mm (experimental value) and 0.4 mm, respectively.

Figure 2A:
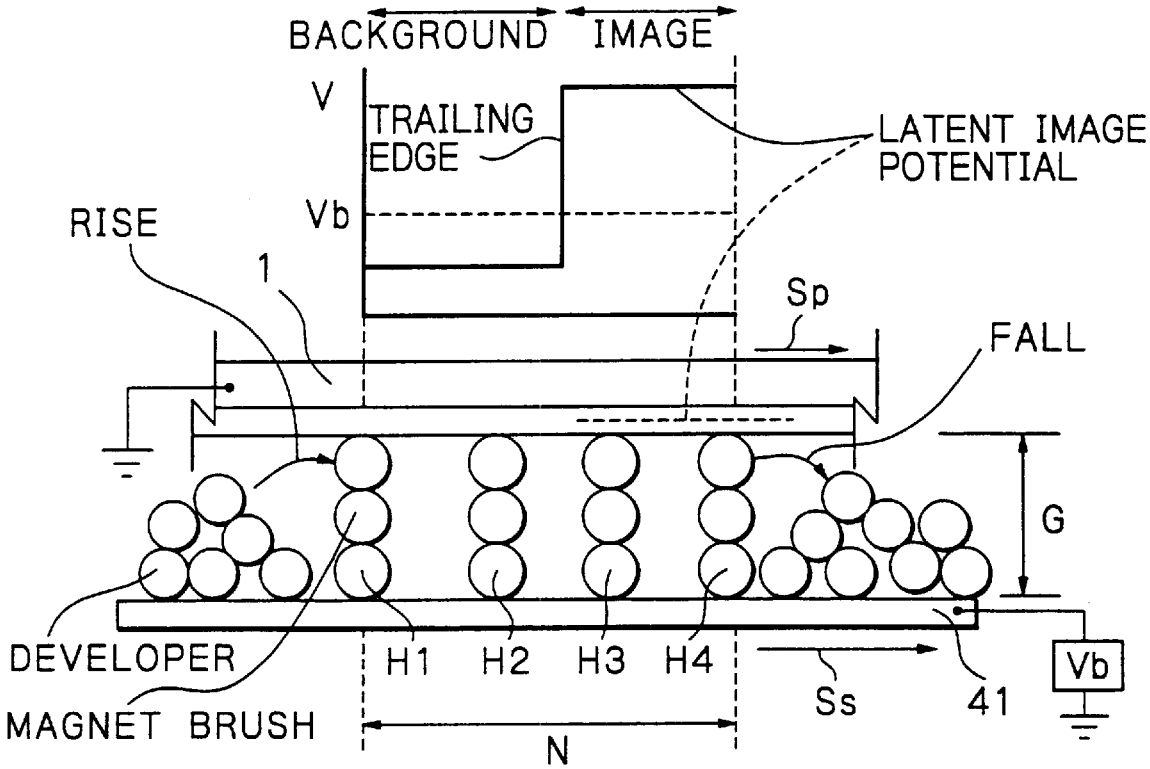
Fig. 2A PRIOR ART
FIGS. 2A and 2B are views each showing the behavior of toner particles deposited on carrier particles occurring at a particular position in a nip formed between an image carrier and a developing sleeve.
Figure 2B:
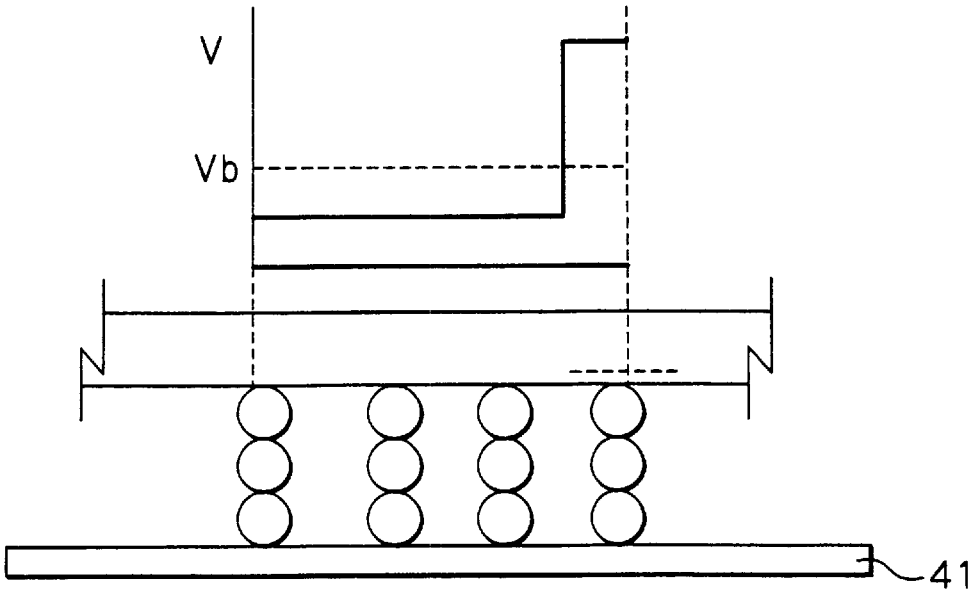
Fig. 2B PRIOR ART

The above magnet brush develops a latent image formed on the image carrier 1 so as to form a corresponding toner image. How toner particles adhering to carrier particles behave at the time of development will be described with reference to FIG. 2A and 2B. FIGS. 2A and 2B each show a relation between the surface potential of the latent image and bias Vb for development, the position of the latent image of the nip N and the movement of the magnet brush around the nip N occurring at a particular condition. While the sleeve 41 is usually implemented as a hollow cylinder, it is shown as being flat for the sake of illustration.

FIG. 2A shows a condition in which a boundary between the background portion and the image portion of the latent image has arrived at substantially the center of the nip N. The image carrier 1 and sleeve 41 move in the same direction, but the former moves at a speed Sp lower than a speed Ss at which the latter moves. In this sense, assume that the image carrier 1 is stationary relative to the developing sleeve 41. Then, the head of the magnet brush rises at a position H1 and causes the carrier particles to start contacting the image carrier 1. The magnet brush passes a position H2 while rubbing itself against the background portion and then passes the image portion at a position H3. Subsequently, the head of the magnet brush falls down at a position H4 with the result that the carrier particles are released from the image carrier 1. The carrier particles at the head of the magnet brush sequentially move from the position H1 to the position H4, i.e., throughout the nip N without changing its height while the individual carrier particle rolls.

Figure 3A:
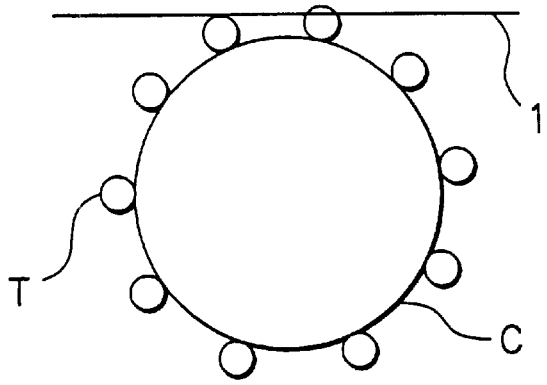
Fig. 3A PRIOR ART
FIGS. 3A through 3D are views each modeling the deposition of toner particles on a single carrier particle occurring in a particular condition.
Figure 3B:
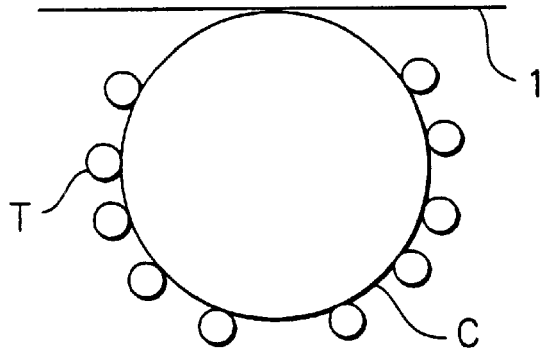
Fig. 3B PRIOR ART

FIGS. 3A–3D model the behavior of toner particles adhered to a single carrier particle and occurring at the consecutive positions H1 through H4. As shown in FIG. 3A, at the position H1, toner particles T comparatively uniformly adhere to a carrier particle C because the position H1 is close to the inlet end of the nip N. As shown in FIG. 3B, at the position H2, the toner particles T move away from the image carrier 1 because an electric field formed by the bias Vb and the potential of the background of the image carrier 1 is directed from the image carrier 1 toward the sleeve 41. As a result, the number of toner particles T decreases in the vicinity of the image carrier 1. More specifically, because the carrier particle C rolls while moving in the nip N, the surface area of the carrier C adjoining the image carrier 1 and where the number of toner T decreases increases with an increase in the width of the nip N.

Figure 3C:
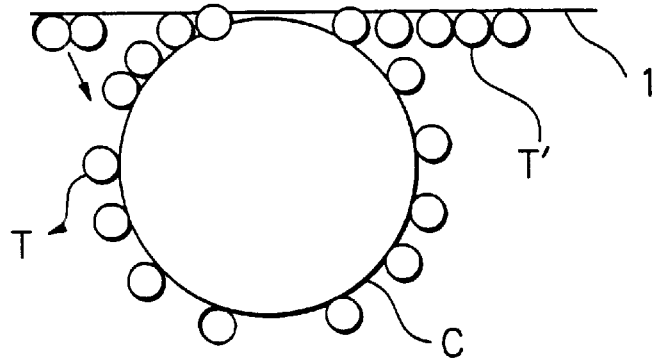
Fig. 3C PRIOR ART

As shown in FIG. 3C, at the position H3, an electric field formed by the bias Vb and the potential of the image portion of the image carrier 1 is directed from the sleeve 41 toward the image carrier 1. However, the toner particles T having moved downward cannot instantaneously deposit on the image of the image carrier 1. During this interval, the part of the magnet brush already moved away from the above image portion causes toner particles T' previous deposited on the image carrier 1 to again deposit on the carrier particle C due to the counter charge of the particle C, as indicated by an arrow in FIG. 3C (Return of Toner). As a result, the number of toner particles T on the carrier particle C increases while the number of toners on the trailing edge of the image formed on the image carrier 1 decreases accordingly.

Figure 3D:
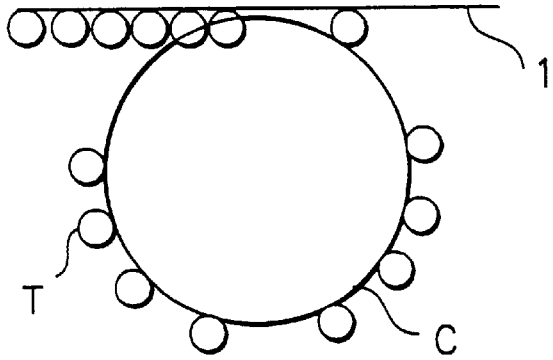
Fig. 3D PRIOR ART

The counter charge of the carrier particle G decreases with the above increase in the number of toner particles T caused by the turn of toner, so that the toner particles T are again caused to easily move to the head of the magnet brush . Specifically, as shown in FIG. 3D, at the position H4, the electric field directed from the sleeve 41 toward the image carrier 1 causes the toner particles T to move toward the image carrier 1 away from the carrier particle C. At the same time, the toner particles T' returned on the carrier particle C again deposit on the image carrier 1.

As shown in FIG. 2B, the trailing edge of the image portion approaches the position H4 due to the relative movement of the sleeve 41 and image carrier 1. The head of the magnet brush then falls down in the condition shown in FIG. 3C. More specifically, substantial part of the toner particles T is returned from the image carrier 1 to the carrier particle C. As a result, the head of the magnet brush falls down with only a small number of toner particles T remaining on the image portion, ending the development. This renders the trailing edge of the image jagged and is particularly conspicuous when it comes to a halftone image. Moreover, when the linear velocity ratio is increased, a greater impact occurs when the magnet brush contacts the image carrier 1 and reduces the adhesion of the toner particles T to the carrier particle C, thereby making the toner particles T easier to move.

A mechanism that makes the trailing edge of the image jagged will be described more specifically hereinafter. Generally, a developer deposited on a developing sleeve rotating around a fixed magnet form a magnet brush. The magnet brush fully rises at a position where a magnetic pole peek exists, but falls down along the surface of the developing sleeve between magnetic poles, i.e., at a position where the tangential magnetic pole is intense. The magnet brush is conveyed by the developing sleeve while repeating the above behavior. This is particularly true when the developer is regulated by a doctor to form a thin layer. When the magnet brush enters a developing region, the developer being conveyed by the sleeve between the main magnet pole and the immediately preceding magnetic pole rises in accordance with a magnetic field formed by the main magnetic pole and contacts an image carrier to the thereby develop a latent image. After the development, the magnet brush falls down in accordance with the above magnetic field while being conveyed to the downstream side.

Figures 4A, 4B:
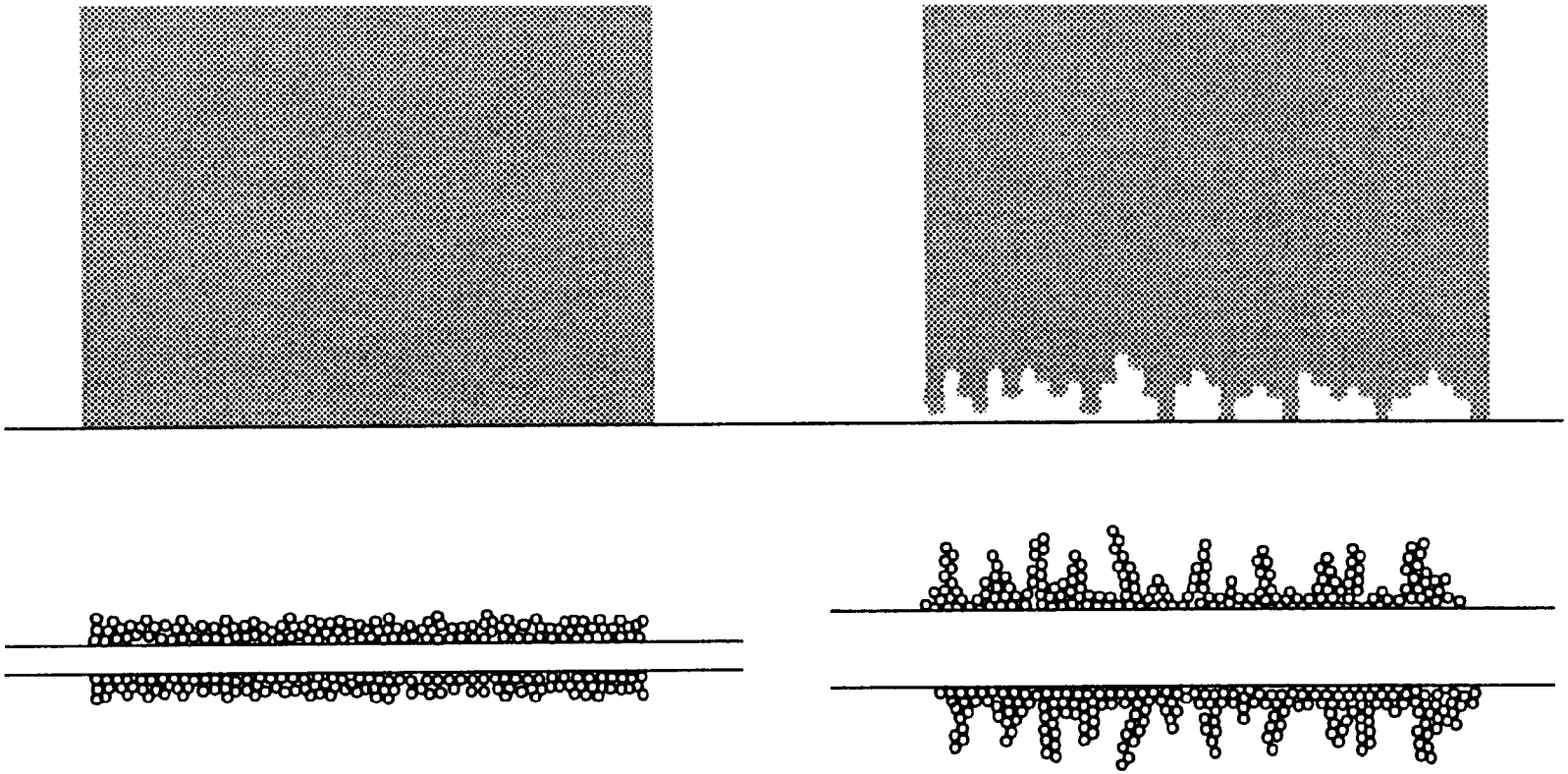
Fig. 4B PRIOR ART
FIGS. 4A and 4B are views comparing the present invention and prior art with respect to the trailing edge of an image in the axial direction of the developing sleeve.

Assume that while the magnet brush rises in accordance with the magnetic field formed by the main magnetic field, the rise is irregular in the axial direction of the sleeve. Then, the magnet brush contacts the image carrier at irregular positions. That is, the condition in which the magnet brush is expected to fully rise at a position deviated from the peak of the main magnetic pole is scattered in the axial direction of the sleeve. This, coupled with the fact that the adjoining portions of the magnet brush in the axial direction of the developing sleeve attract each other, causes the brush to form separate large heads. Such heads contact the image carrier at different positions in the axial direction of the developing sleeve. This occurs even after the magnet brush has contacted the image carrier. Consequently, as shown in FIG. 4B, the trailing edge of an image is jagged due to the counter charge of the carrier particles existing at the tip of the magnet brush, as stated earlier. If the magnet brush could uniformly rise in the axial direction of the sleeve, the trailing edge of an image would be free from jaggedness or local omission, as shown in FIG. 4A.

Figure 5:
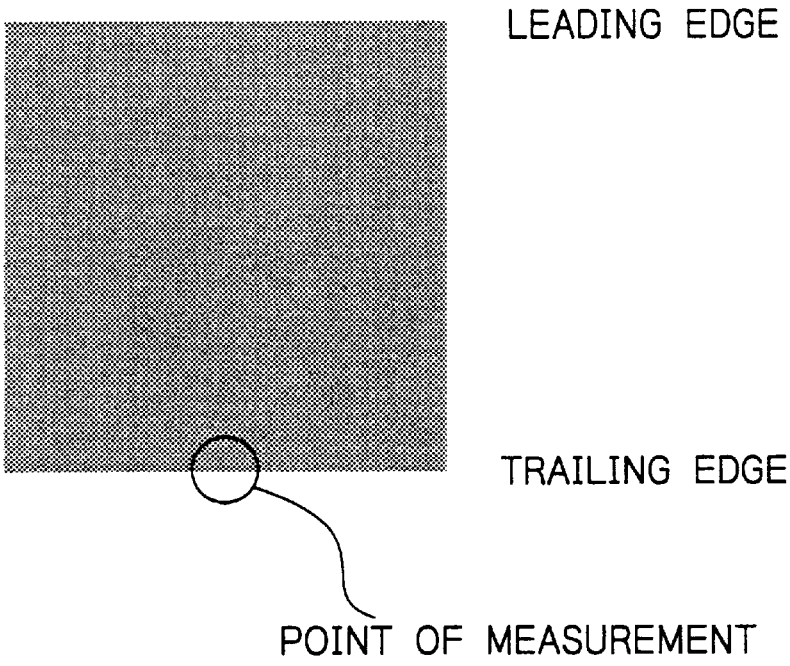
FIG. 5 is a view showing a specific solid image used to observe the local omission of the trailing edge of an image.
Figure 6:
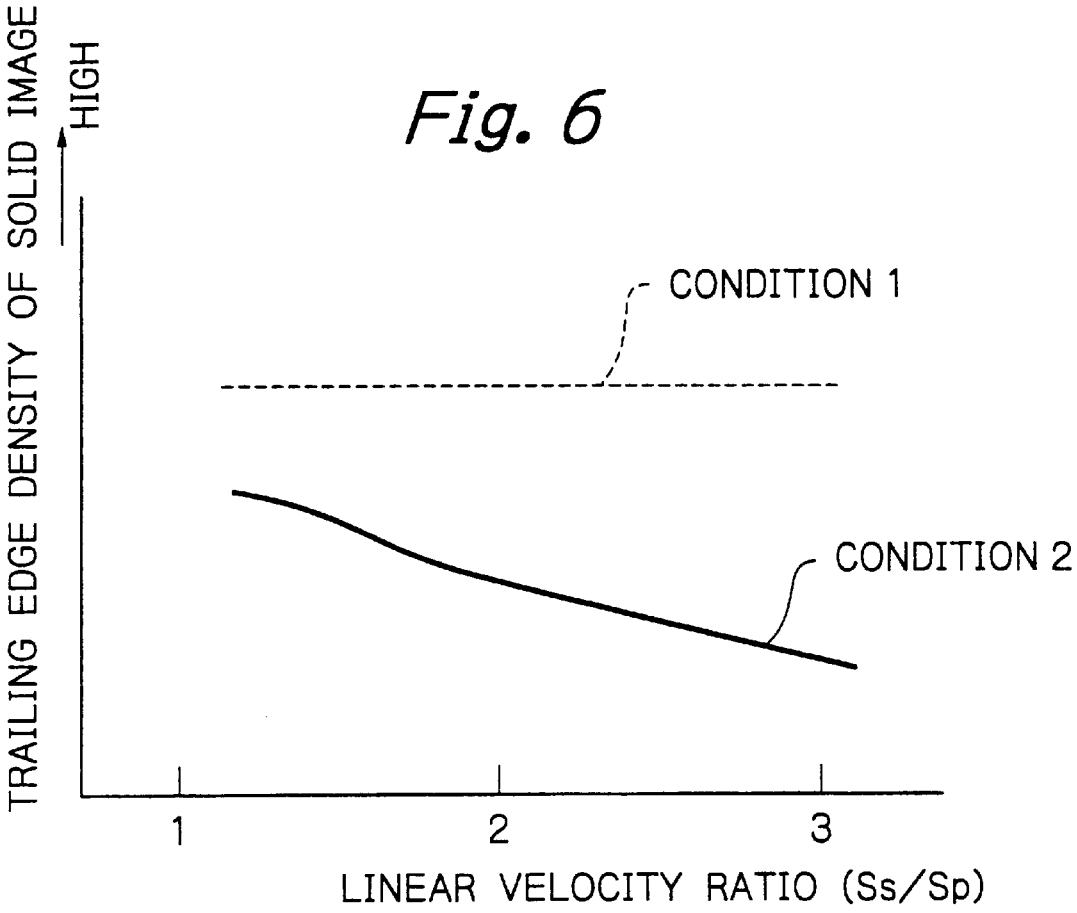
FIG. 6 is a graph showing a relation between a ratio of the linear velocity of the developing sleeve to that of an image carrier and image density.

FIG. 5 shows a specific solid image sized several centimeters square. Area density was measured over the diameter of about 5 mm of the solid image in order to determine raggedness. The measurement derived a density characteristic represented by a condition 2 (nip width of about 4 mm) shown in FIG. 6. In FIG. 6, the ordinate and abscissa respectively indicate the density of the trailing edge of the solid image and the ratio of the sleeve velocity Ss to the image carrier velocity Sp. As FIG. 8 indicates, when the linear velocity ratio Ss/Sp is increased from about 1.1, the image density increases at portions other than the portion where jaggedness occurs, but the condition shown in FIG. 3C is conspicuous. As a result, the jaggedness is aggravated and sequentially increases in width, so that the result of measurement is noticeably scattered at the position of measurement.

To solve the above problem, it is necessary to find, based on the behavior described with reference to FIGS. 2A, 2B and 3A through 3D, a condition that obviates the occurrence shown in FIG. 3B. It is also necessary to find a method capable of implementing a characteristic represented by a condition 1 shown in FIG. 6, i.e., preventing the density of the trailing edge from decreasing even when the linear velocity ratio is increased or causing it to increase with an increase in linear velocity ratio because of an increase in toner supply.

For the above purpose, the difference between the bias Vb and the background potential may be reduced to zero. This implementation, however, is not practical because toner has a charge distribution and because a potential capable of protecting the background from contamination must be selected in matching relation to an amount of charge apt to bring about background contamination. On the other hand, toner containing magnetic particles would only slowly move due to the influence of the magnetic field on the sleeve side, successfully reducing the occurrence shown in FIG. 3B. This, however, also reduces the amount of toner to deposit on the image portion of the image carrier to thereby prevent image density from increasing, and moreover cannot implement color toner due to the magnetic particles. While the carrier may have its characteristic or surface configuration improved, changing such a factor of the carrier only for achieving the above purpose is not practical either.

For high image quality, the reproducibility of thin lines, particularly a horizontal-to-vertical ratio, the reproducibility of dots, the uniform deposition of toner and other factors should be considered and should be achieved together with the obviation of the raggedness discussed above.

Figure 7:
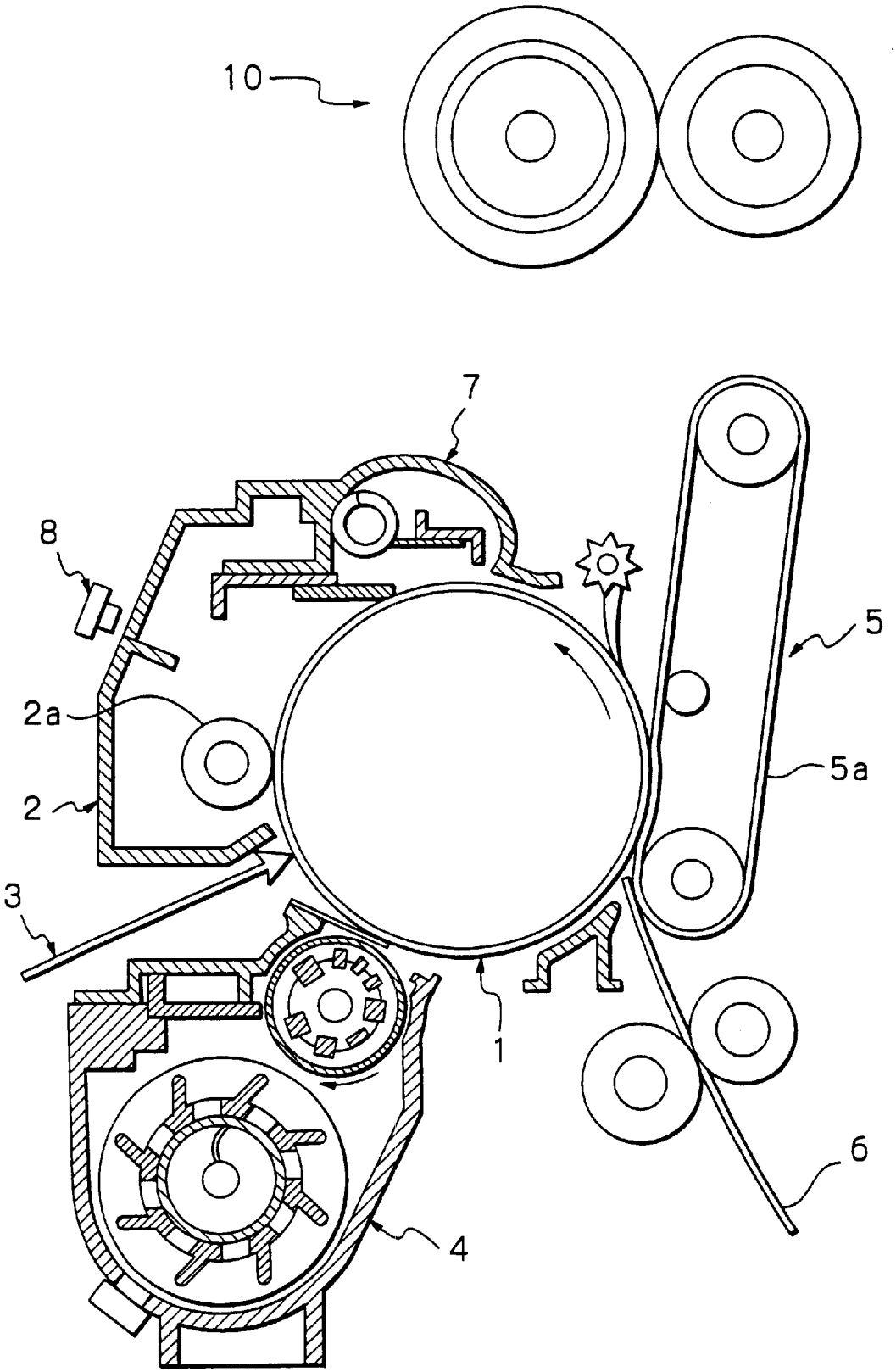
FIG. 7 is a view showing an image forming apparatus embodying the present invention.

Referring to FIG. 7, an image forming apparatus embodying the present invention will be described. As shown, the apparatus includes an image carrier implemented or a photoconductive drum 1. Sequentially arranged around the drum 1 are a charger 2, laser option 3, a developing devices 4, an image transfer device 5 including a belt 5*a,* a drum cleaning device 7, and a discharge lamp 8. The charger 2 uniformly charges the surface of the drum 1. The laser option 3 scans the charged surface of the drum 1 with a laser beam for thereby forming a latent image. The developing device 4 develops the latent image with charged toner to thereby form a corresponding toner image. The image transfer device 5 transfers the toner image from the drum 1 to a paper or similar recording medium 8. The drum cleaning device 7 removes toner left on the drum 1 after image transfer, and then the discharge lamp 8 dissipates charge left on the drum 1.

In operation, a charge roller 2*a* included in the charger 2 uniformly charges the surface of the drum 1. The laser optics 3 forms a latent image on the charged surface of the drum 1. The developing device 5 develops the latent image with toner and thereby produces a corresponding toner image. The image transfer device 5 transfers the toner image from the drum 1 to the paper 6 fed from a tray not shown. At this instant, a peeler 9 pools off the paper 6 electrostatically adhering to the drum 1. A fixing device 10 fixes the toner on the paper 6. Subsequently, the drum cleaning device 7 removes and collects the toner left on the drum 1 after the image transfer from the drum 1 to the paper 8. The discharge lamp 8 then initializes the drum 1 so as to prepare it for the next image forming cycle.

Figure 8:
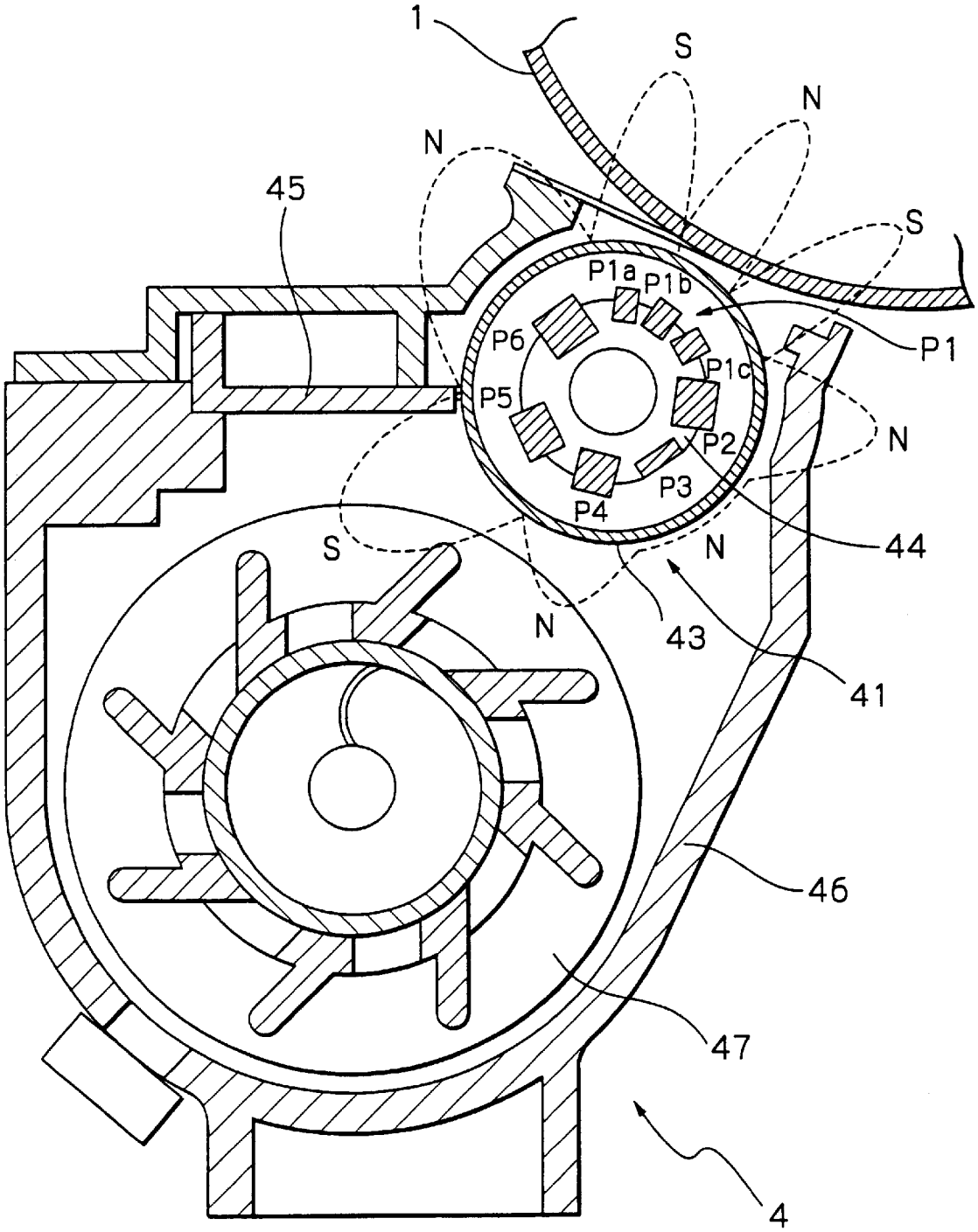
FIG. 8 is a section showing a specific configuration of a developing device included in the illustration embodiment.

FIG. 8 shows the developing device 4 in detail. As shown, a developing roller of developer carrier 41 is disposed in the developing device 4 and adjoins the drum 1. The roller 41 and drum 1 form a developing region therebetween. The developing roller 41 includes a hollow cylindrical sleeve 43 formed of aluminum, brass, stainless steel, conductive resin or similar nonmagnetic material. A drive mechanism, not shown, causes the sleeve 43 to rotate clockwise as seen in FIG. 7. In the illustrative embodiment, the drum 1 has a diameter of 60 mm and moves at a linear velocity of 240 mm/sec while the sleeve 43 has a diameter of 20 mm and moves at a linear velocity of 600 mm/sec. Therefore, the linear velocity ratio of the sleeve 43 to the drum 1 is 2.5. A gap of 0.4 mm for development is formed between the drum 1 and the sleeve 43. While the conventional gap for development is about 0.65 mm to about 0.8 mm for a carrier particle size of 50 $\mu$m, i.e., more than the times greater than the carrier particle size, the gap should preferably be less than ten times (0.55 mm) in the illustrative embodiment. Greater gaps would fail to implement desirable image density.

A doctor blade 45 is positioned upstream of the developing region in the direction in which the sleeve 43 conveys the developer (clockwise in FIG. 8). The doctor blade 45 regulates the height of the head of the developer chain, i.e., the amount of developer deposited on the sleeve 43. A doctor gap between the doctor blade 45 and the sleeve 43 is selected to be 0.4 mm. A screw 47 is positioned at the side opposite to the drum 1 with respect to the developing roller 41 in order to scoop up the developer stored in a casing 46 while agitating it.

A magnet roller 44 is fixed in place within the sleeve 43 for causing the developer deposited on the sleeve 43 to rise in the form of a head. Specifically, a carrier contained in the developer form chain-like heads on the sleeve 43 along magnetic lines of forces normal to the magnet roller 44. Charged toner also contained in the developer adheres to the heads of the carrier, forming a magnet brush. The sleeve 43 in rotation conveys the magnet brush clockwise.

Figure 9:
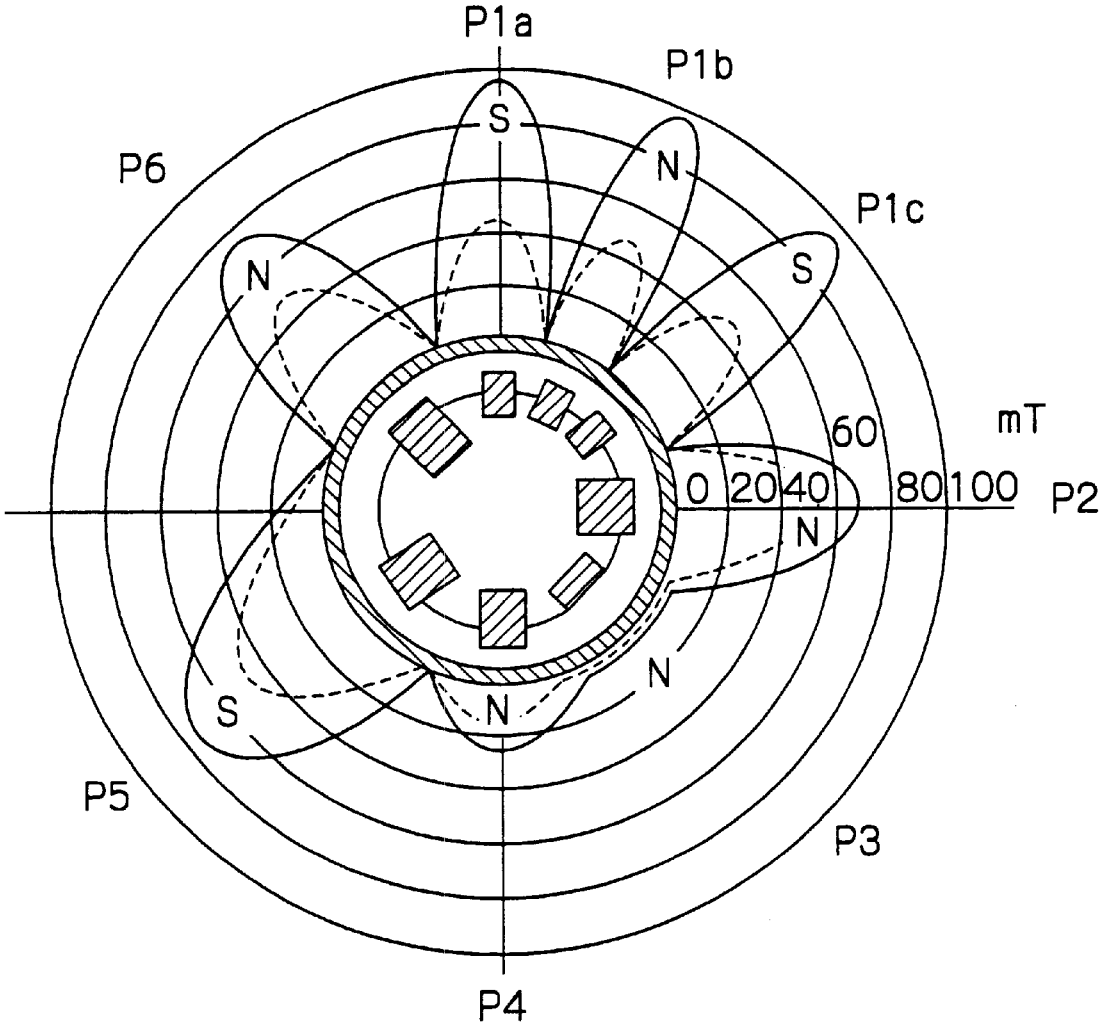
FIG. 9 is a circle chart showing the magnetic force distribution of a developing roller included in the developing device and the sizes of magnetic forces.

The magnet roller 44 has a plurality of magnets or magnetic poles. Specifically, as also shown in FIG. 9, a main magnet P1b causes the developer to rise in the form of a head in the developing region. Auxiliary magnets P1a and P1c help the main magnet P1B form a magnetic force. A magnet P4 causes the developer to deposit on the sleeve 43. Magnets P5 and P6 serve to convey the developer deposited on the sleeve 43 to the developing region. Further, magnetic P2 and P3 serve to convey the developer over a region following the developing region. The magnets P1b through P3 each are oriented in the radial direction of the sleeve 43. While the magnet roller 44 is shown as having eight magnets, additional magnets or magnetic poles may be arranged between the magnet P3 and the doctor blade 45 in order to enhance the ability to scoop the developer and the ability to follow a black solid image. For example, ten to twelve magnets may be arranged in total.

As shown in FIG. 8, the magnetics P1a, P1b and P1c (main magnet group P1 collectively) are sequentially arranged in this order from the upstream side to the downstream side, and each have a relatively small cross-sectional area. While the main magnet group P1 is formed of an alloy of rare-earth metal, use may be made of a samarium alloy, particularly samarium-cobalt alloy. Typical of magnetic formed of rare-earth metal alloys are an iron-neodium-boron alloy magnet with which the maximum energy product of 358 kd/m$^2$ is achievable and an iron-neodium-boron alloy bond magnet with which the maximum energy product of 80 kd/cm$^3$ is achievable. A magnet formed of such a material can provide the roller surface with a required magnetic force even when greatly reduced in size. The maximum energy product available with conventional magnets formed of ferrite and ferrite bond are not greater than about 38 kJ/m$^3$ and about 20 kJ/m$^3$, respectively, if the diameter of the sleeve 43 is allowed to be increased, the half-width may be reduced by using a ferrite magnet or a ferrite bond magnet having a greater size or by thinning the tip of the magnet adjoining the sleeve 43.

If desired, the magnets each having a relatively small cross-section area may be replaced with a single magnet roller implemented as a molding. Further, the magnets other than the main magnet group P1 may be implemented as a molding, in which case the magnetic P1a through P1c each will be individually formed or also implemented as a molding. In addition, a sectorial magnet may be adhered to a magnet roller shaft.

In the illustrative embodiment, the main magnet P1b and magnets P4, P6, P2 and P3 are magnetized to the n-pole while the magnets P1a, P1c and P5 are magnetized to the s-pole. FIG. 9 is a circle chart showing flux densities in the normal direction determined by measurement. As shown, the main magnet P1b had a magnetic force of 85 ml of above in the direction normal to the developing roller 41. It was experimentally found that when the magnet P1c downstream of the main magnet p1b had a magnetic force of 60 Tm or above, defective images including one with carriers deposited thereon were obviated. Magnetic forces of 80 Tm or below caused carrier particles to deposit on images. A tangential magnetic force is the magnetic forces relating to carrier deposition. While the magnetic forces of the magnets P1b and P1c should be increased to increase the above tangential force, carrier deposition can be sufficiently reduced if either one o them is sufficiently great. The magnets P1a, P1b and P1c each were 2 mm wide. In this condition, the half-width of the magnet P1b was 16°.

Figure 10:
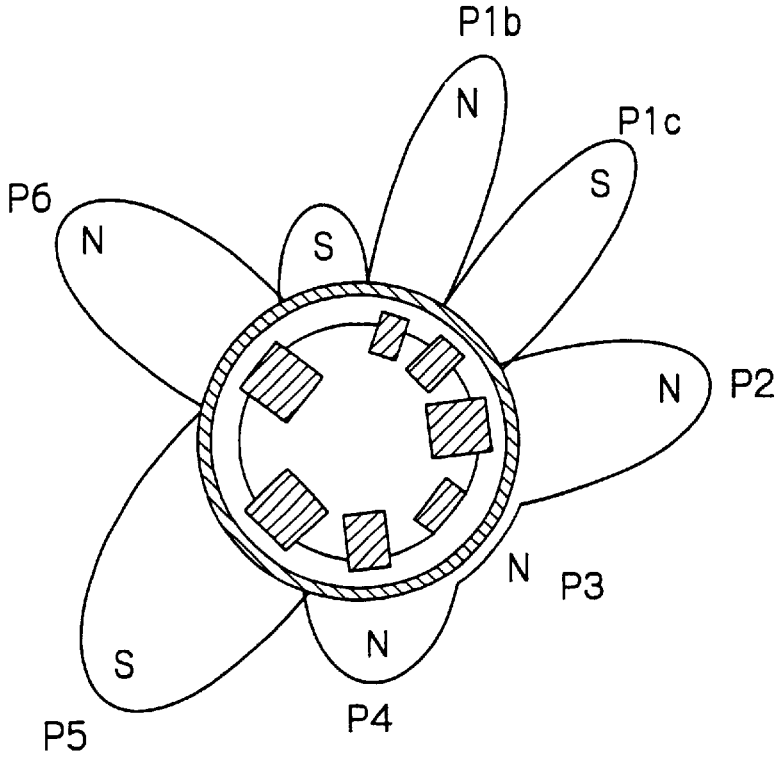
FIG. 10 is a view showing a magnetic force distribution occurring when one magnet is absent.

As shown in FIG. 10, when only the auxiliary magnet P1c was located downstream of the main magnet P1b, the magnetic force of the main magnet P1b was reduced by several percent although the half-width of the main magnet P1b remained the same. Specifically, the magnetic force at the position corresponding to the auxiliary magnet P1a was reduced to about 30 ml due to the absence of the magnet P1a. However, this portion can be covered with an inlet seal and is not exposed to the image forming section. It is therefore possible to convey the developer to the main magnet P1c without affecting images. By further reducing the width of the magnet, it is possible to further reduce the half-width, as determined by experiments. When the magnet was 1.6 mm wide, the main pole had a half-width of 12°.

Figure 11:
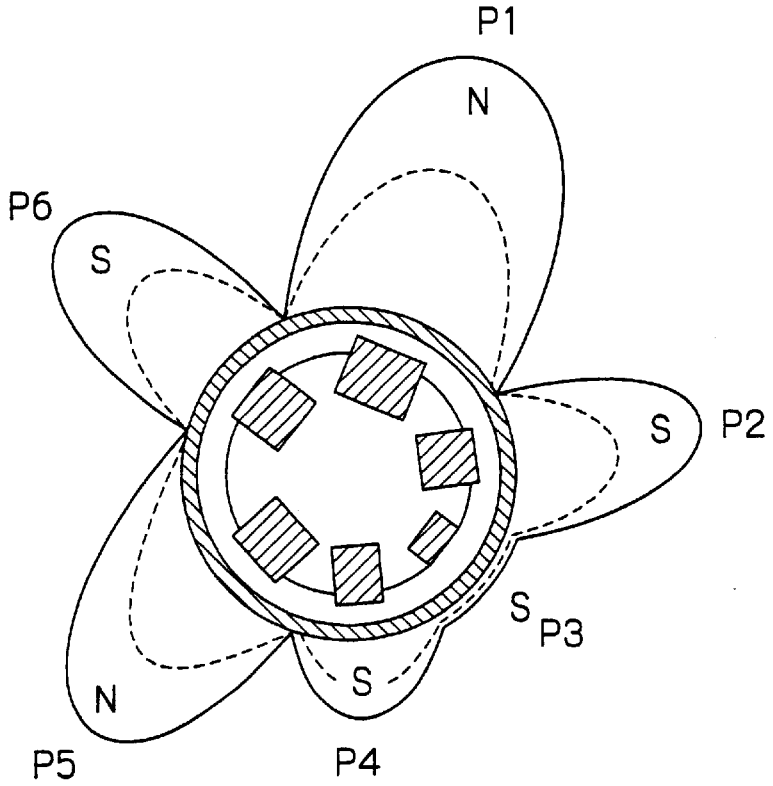
FIG. 11 is a view similar to FIG. 10, showing the magnetic distribution of a conventional developing roller for comparison.

Referring again to FIG. 9 showing a magnetic force pattern in the normal direction, solid curved representative of flux densities measured on the surface of the sleeve 43 while phantom curves are representative of flux densities measured at a distance of 1 mm from the surface of the sleeve 43. For comparison, FIG. 11 shows a flux density distribution available with a conventional magnet roller. For measurement, a gauss meter HGM-8300 and an axial probe type A1 available from ADS were used. The results of measurement were recorded by a circle chart recorder.

In the illustrative embodiment, the flux density of the main magnet P1b in the direction normal to the surface of the sleeve 43 was measured to be 95 ml of the surface of the sleeve 43 or 44.4 ml at the distance of 1 mm from the same. That is, the flux density varied by 50.8 ml. In this case, the attenuation ratio of the flux density in the direction normal to the sleeve 43 was 53.5%. It is to be noted that the attenuation ratio is produced by subtracting the peak flux density at the position spaced by 1 mm from the sleeve surface from the peak flux density on the sleeve surface and then dividing the resulting difference by the latter peak flux density.

The auxiliary magnet P1a upstream of the main magnet P1b had a flux density of 93 ml in the direction normal to the sleeve surface on the sleeve surface or a flux density of 49.6 ml at the position 1 mm spaced from the same; the flux density varied by 43.4 ml, and the attenuation ratio was 46.7%. The other auxiliary magnet P1c downstream of the main magnet P1b had a flux density of 92 ml in the direction normal to the sleeve surface on the sleeve surface or a flux density of 51.7 ml at the position 1 mm spaced from the same; the flux density varied by 40.3 ml, and the attenuation ratio was 43.8%. In the illustrative embodiment, only the brush portion formed by the main magnet P1b contacts the drum 1 and develops a latent image formed on the drum 1. In this connection, the magnet brush was about 1.5 mm long at the above position when measured without contacting the drum 1. Such a magnet brush was shorter than the conventional length of about 3 mm and therefore more dense than the conventional magnet brush.

For a given distance between the developer regulating member and the sleeve, i.e., for a given amount of developer to pass the regulating member, the illustrative embodiment made the magnet brush shorter and more dense than the conventional magnet brush at the developing region, as determined by experiments. This will also the understood with reference to FIG. 8. Because the flux density in the normal direction measured at the distance of 1 mm from the sleeve surface noticeably decreases, the magnet brush cannot form a chain at a position remote from the sleeve surface and is therefore short and dense. In this connection, as shown in FIG. 11, the flux density available with the main pole of the conventional magnet roller was 73 ml on the sleeve surface or 51.8 ml at the distance of 1 mm from the sleeve surface; the flux density varied by 21.2 ml, and the attenuation ratio was 29%.

Figure 12:
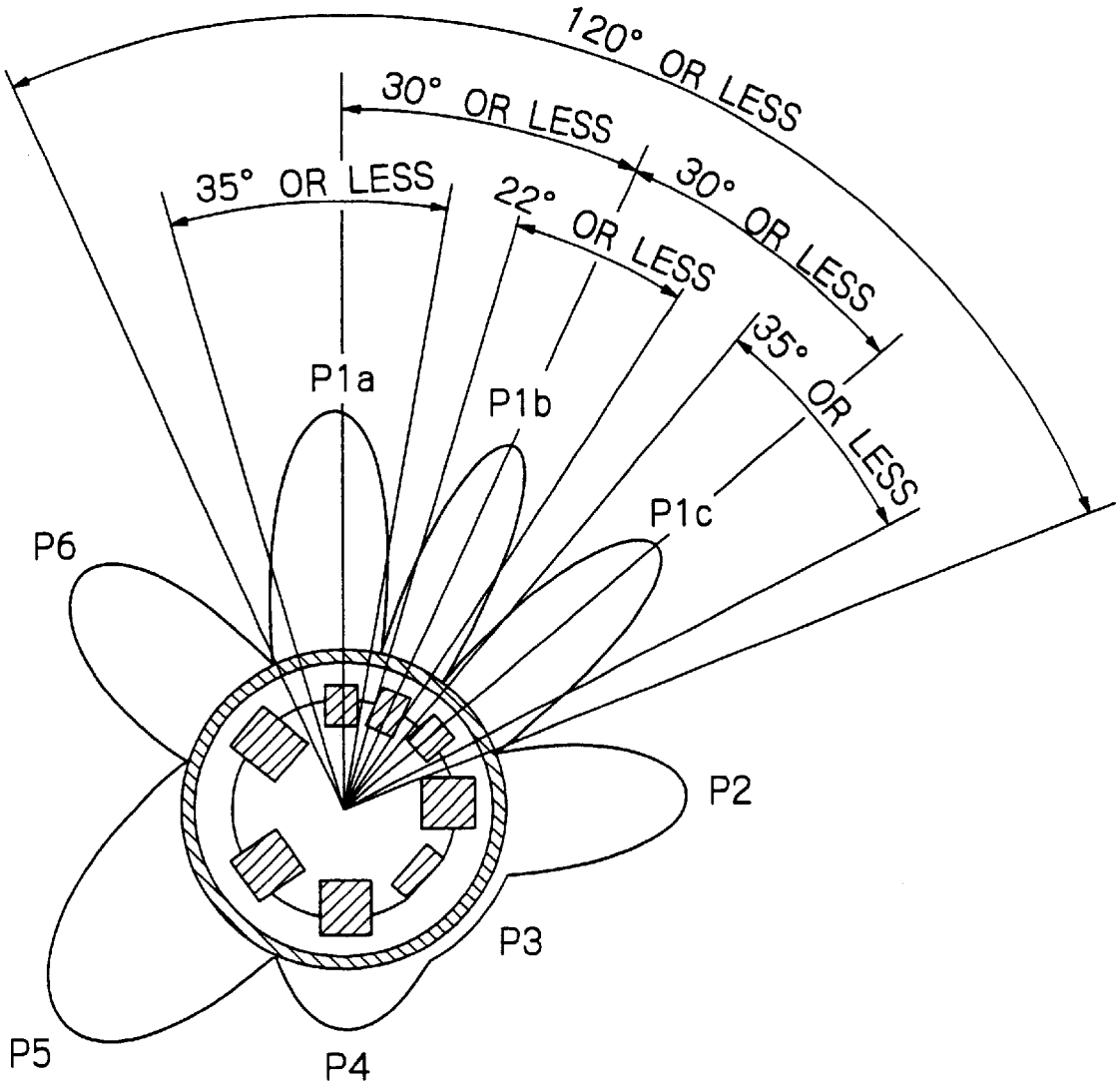
FIG. 12 is a view showing a relation in angle between a main magnet and auxiliary magnets helping the main magnet for a magnetic force.

FIG. 12 shows the positional relation between the main magnet P1b and the auxiliary magnets P1a and P1c on the basis of the teachings of FIG. 8. As shown, when the maximum magnetic force of the main magnet P1b in the normal direction is 95 ml, the half value is 47.5 ml, and the half-width thereof is 22°. Experiments showed that half-width greater than 22° resulted in defective images.

The auxiliary magnets P1a and P1c each is provided with a half-width of 35° or less. Because the magnetic P8 and P2 positioned outward of the auxiliary magnets P1a and P1c, respectively, each have a great half-width, the half-width at each of the magnetic P1a and P1c cannot be reduced relative to the main magnet P1b. Further, the angle between the main magnet P1b and each of the auxiliary magnetic P1a and P1c is selected to be 30° or less. In the illustrative embodiment in which auxiliary magnetic poles are formed at both sides of the main magnetic pole, the half-width at the main pole is selected to be 16°, and therefore the above angle is selected to be 22°. In addition, polarity transition points (0 mT and where the s-pole and n-pole replace each other) between the auxiliary magnets P1 and P1c and the magnetic P2 and P6 make an angle of 120° or less therebetween.

FeNdB bond magnet rollers unique to the illustrative embodiment and respectively having diameters of 16 mm and 20 mm were prepared. Also, conventional magnet rollers respectively having diameters 16 mm and 20 mm were prepared. FIG. 13 compares such magnet rollers with respect to flux density, half center angle, half-width, and magnetic pole. For measurement, the axial probe and gases meter mentioned earlier were also used. A Hall element for measuring the flux density in the normal direction was spaced from the sleeve surface by 0.5 mm.

The condition described above is successful to reduce the local omission or jaggedness of the trailing edge of an image. Specifically, by reducing the half-width of the main pole, it is possible to implement the rise and fall of a short magnet brush and therefore to reduce the nip for development. It follows that the movement of the toner particles from the tip toward the root of the magnet brush (FIG. 3B) is reduced as far as possible. This, coupled with the fact that the rise and fall of the magnet brush is uniformed in the axial directed of the sleeve, frees the trailing edge of an image from jaggedness or local omission.

Figure 14:
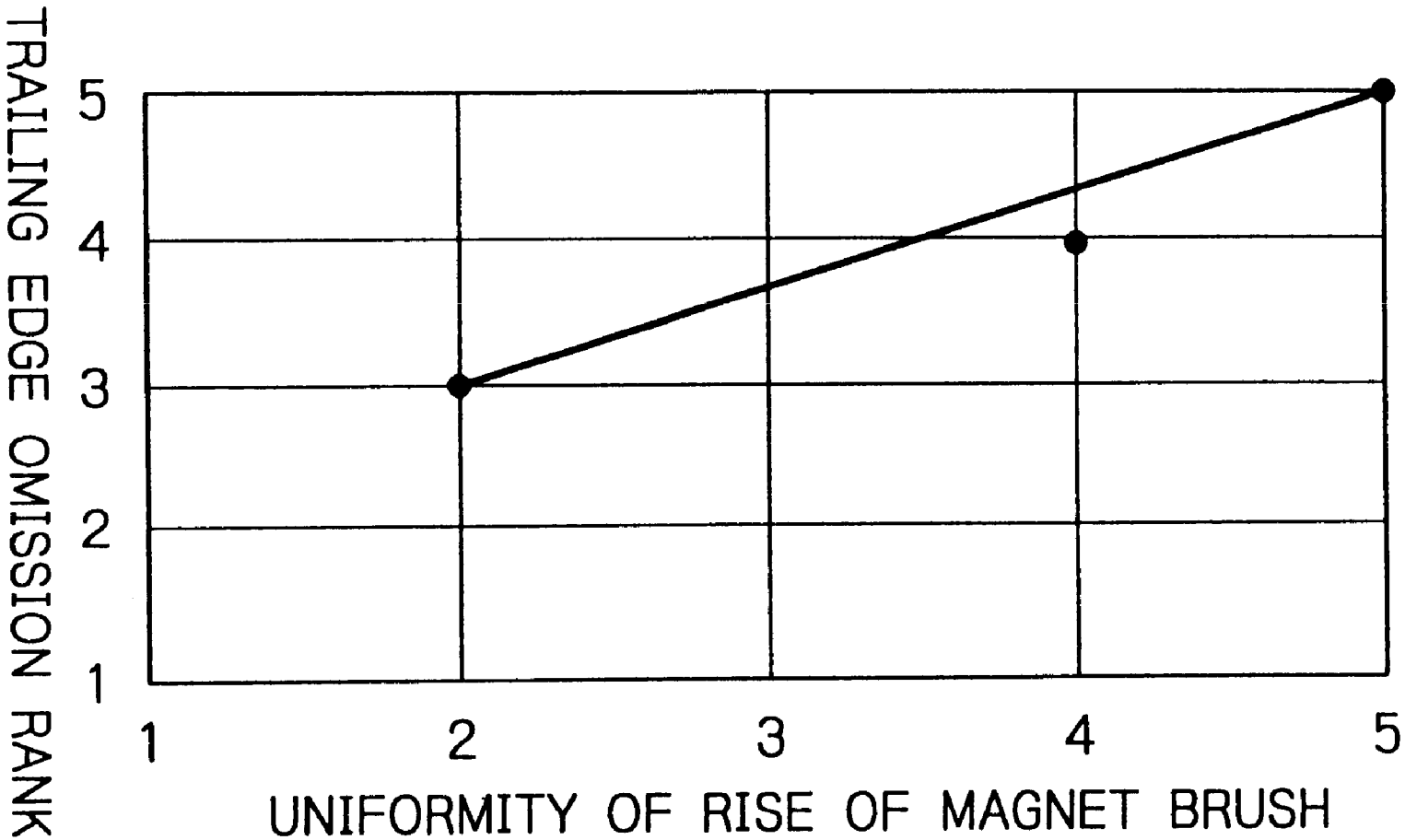
FIG. 14 is a graph showing a relation between the uniformity of the rise of a magnet brush and the rank of the omission of the trailing edge of an image.

FIG. 14 shows a relation between the degree of uniformity of the rise of the magnet brush and the rank of the local omission of the trailing edge of an image. The magnet brush is caused to rise along the magnetic lines of force generated by the main magnet, as stated earlier. In FIG. 14, the lower the rank, the more the rise of the magnet brush becomes irregular. As shown, a higher local omission rank is achievable with a higher degree of uniformity.

When the rise of the magnet brush is not uniform, it irregularly contacts the image carrier with the result that the toner behaves in different manners at different positions in the axial direction of the sleeve. As a result, the distances that the toner moves depends on the charge of a non-image portion. This makes the toner density irregular in the axial direction in the vicinity of the image carrier and thereby causes the trailing edge of an image to be locally omitted. So long as the magnet brush rises uniformly, the magnet brush uniformly contacts the image carrier in the axial direction of the sleeve, as shown in FIG. 4A. It follows that the toner moves uniformly and protects the trailing edge of an image from local omission. Also, the magnet brush should preferably be uniformly released from the image carrier at the outlet of the developing region. Specifically, if the magnet brush uniformly falls down in the axial direction of the sleeve when leaving the developing region, a uniform scavenging force acts. If the magnet brush fall down non-uniformly, as has been the case with the conventional magnet roller, the scavenging force becomes irregular and causes the brush to sweep away the trailing edge of an image, resulting in a defective image.

Figure 15:
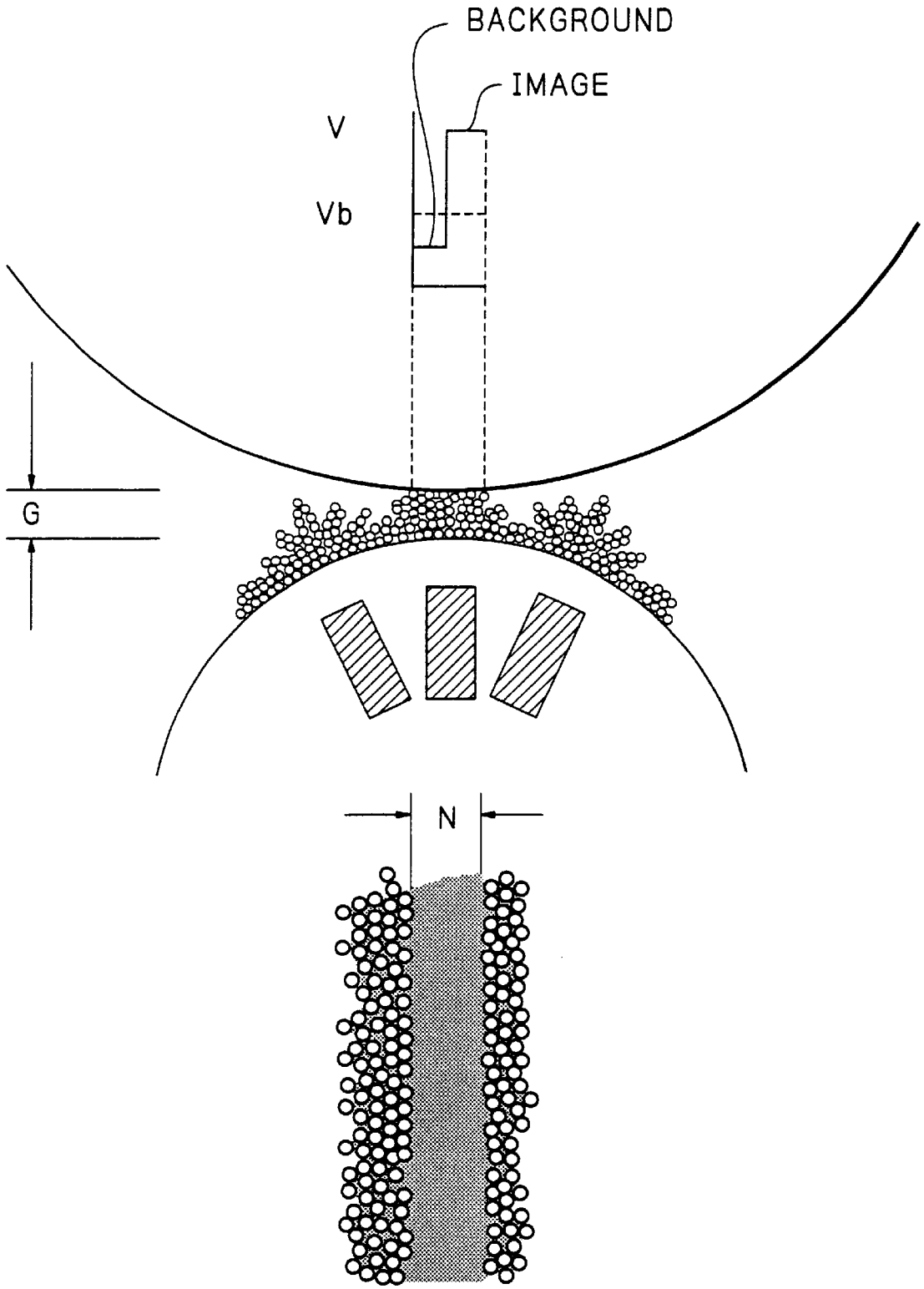
FIG. 15 is a view similar to FIG. 1, showing a gap for development and a nip particular to the present invention.

The illustrative embodiment is capable of improving the reproducibility of horizontal lines (particularly vertical-to-horizontal ratio), the reproducibility of dots and the uniformity of toner deposition while reducing the local omission or raggedness of the trailing edge of an image. This will be understood by comparing FIG. 1 with FIG. 15.

If the main pole can be further controlled to allow the carrier to contact the image carrier only in a single row, it is possible to develop a latent image with a nip width of [carrier particle size×linear velocity ratio (Sn/Sp)] or above.

Figure 18:
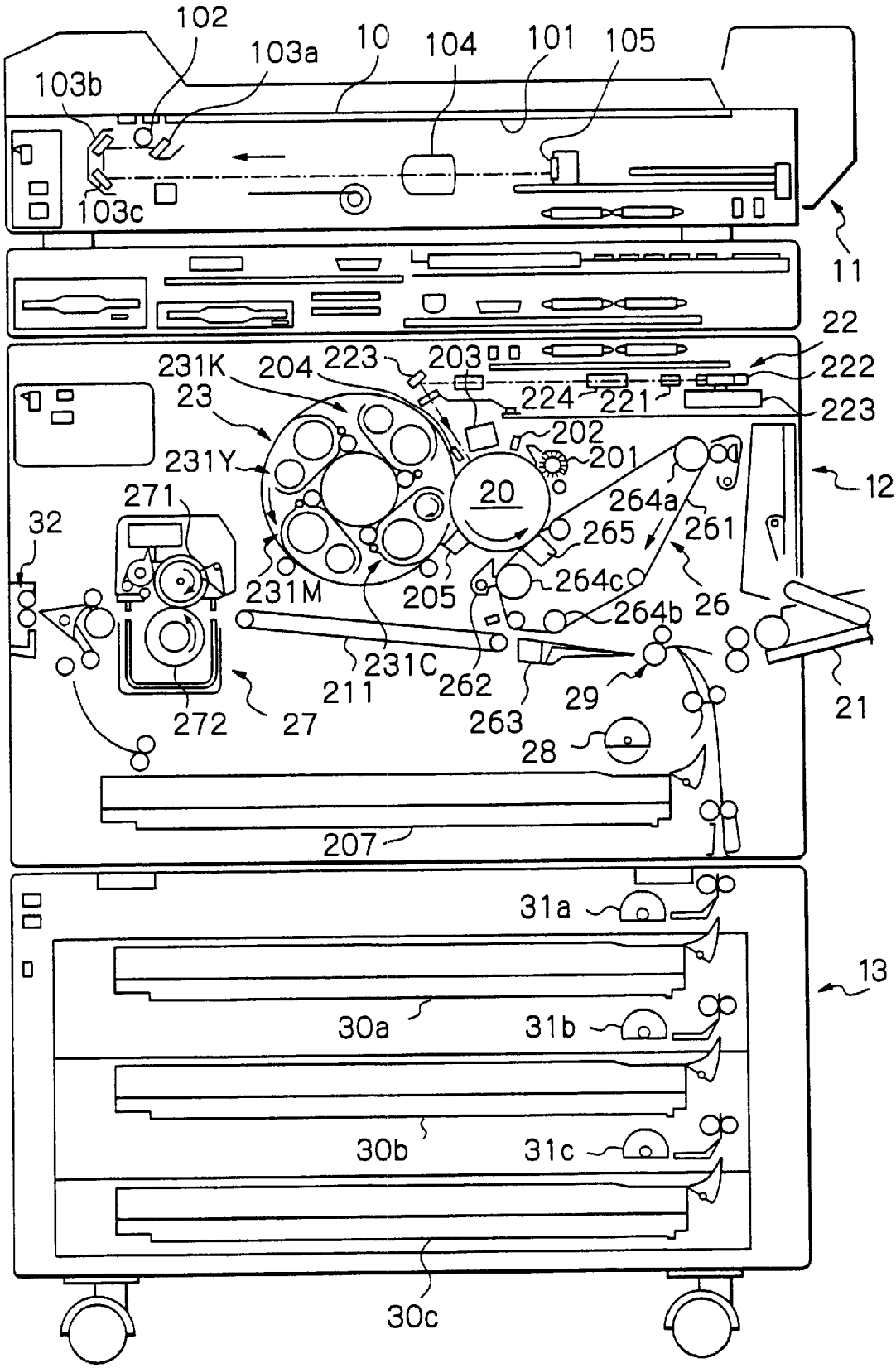
FIG. 18 is a view showing a color copier that is a specific form of the image forming apparatus of the present invention.

The uniformity of a magnet brush may be represented by a half-width. FIG. 18 shows a relation between the half-width of the main pole and the uniformity of the rise of a magnet brush. As shown, the uniformity of the rise increases with a decreases in half-width. As FIG. 14 clearly indicates, the uniformity of the rise of the magnet brush improves an image.

Figure 16:
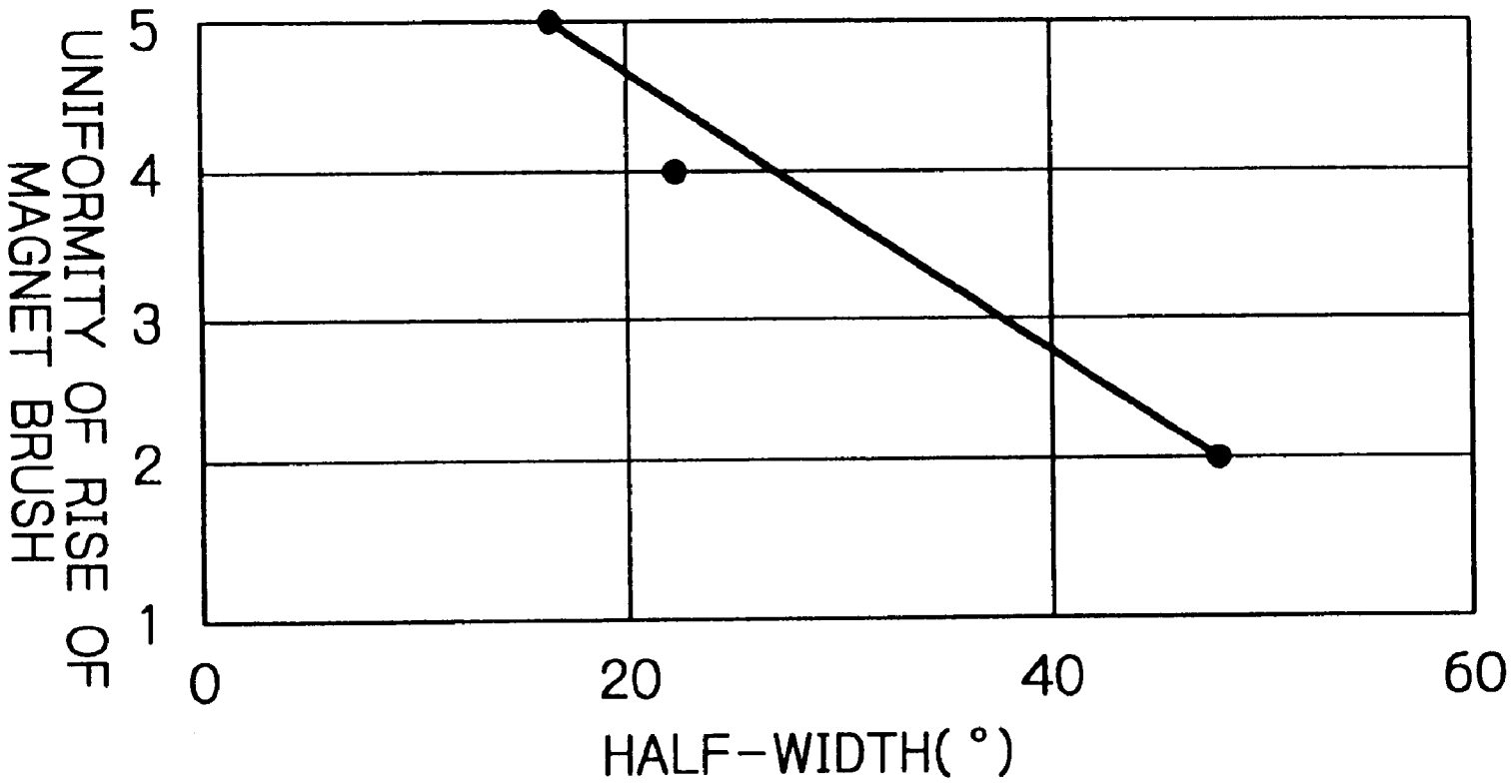
FIG. 16 is a graph showing a relation between the half-width of the main magnetic pole and the uniformity of the rise of a magnet brush.
Figure 17:
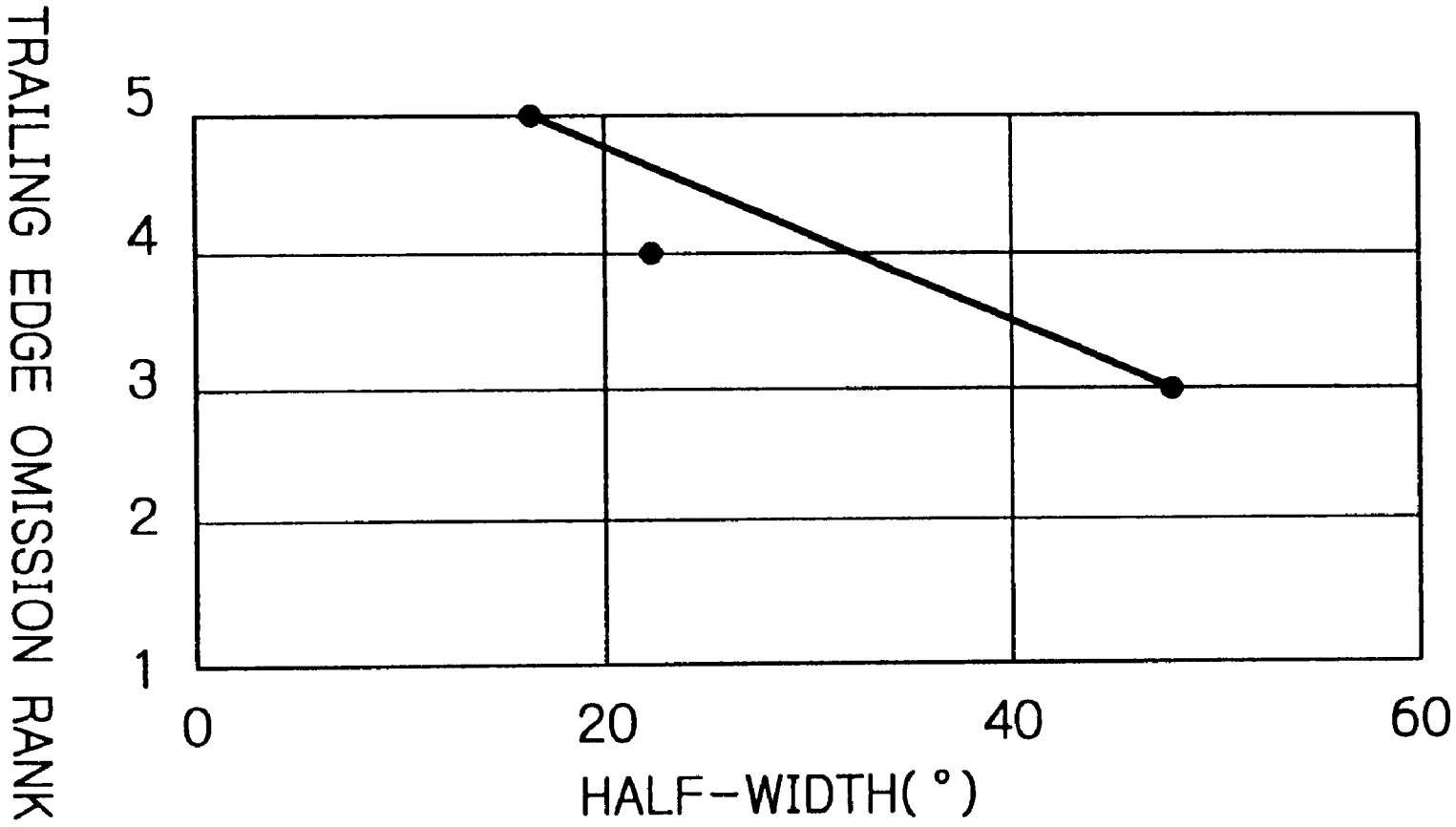
FIG. 17 is a graph showing a relation between the half-width of the main magnetic pole and the omission of the trailing edge of an image.

Further, by reducing the half-width, it is possible to achieve a higher local omission rank, as FIG. 17 indicates. FIG. 17 is derived from a relation between FIGS. 14 and 16. Because the uniformity of the rise of the magnet brush increases with a decrease in half-width (FIG. 16) and because the local omission rank rises with an increase in the uniformity of the rise (FIG. 14), the relation shown in FIG. 11 holds.

The uniform rise of the magnet brush can be implemented if use is made of a magnet roller having a high attenuation ratio for forming the main magnetic pole. It was experimentally found that the attenuation ratio increases with a decrease in half-width. The width of the magnet (in the circumferential direction of the sleeve) may be reduced to reduce the half-width. This, however, increases the number of magnetic lines of force turning round to adjoining magnets and thereby reduces the flux density in the normal direction at a portion remote from the sleeve surface. Specifically, a substantial clearance that is the sum of the space accommodating the magnet roller and necessary for the sleeve to rotate and the wall thickness of the sleeve exists between the magnet roller and the sleeve. As a result, the tangential flux density concentrates on the sleeve side, causing the normal flux density to decrease with an increase in the distance from the sleeve surface.

A magnet roller with a great attenuation ratio successfully forms a short, dense magnet brush, as stated earlier. By contrast, the conventional magnet roller with a small attenuation ratio forms a long, rough magnet brush. Specifically, a magnetic field formed by the magnet with a great attenuation ratio (e.g. P1*b*) is easily attracted by adjoining magnets (e.g. P1*a* and P1*c*), so that the flux turns round in the tangential direction rather than spreading in the normal direction. This makes it difficult to form a magnet brush in the normal direction and thereby implements a short, dense magnet brush. As for the magnet P1*b*, for example, having a great attenuation ratio, short magnet brushes adjoining each other are more stable than a single elongate magnet brush. As for the conventional magnet roller with a small attenuation ratio, the magnet brush does not become short even if the amount of developer to be scooped up is reduced, and has substantially the same length as the previously stated magnet brush.

A great attenuation ratio is also achievable by locating the auxiliary magnets closer to the main magnet in the circumferential direction of the sleeve. This increases the number of magnetic lines of force turning round from the main magnetic pole to the auxiliary magnetic poles.

By reducing the half-width of the main pole for implementing the rise and fall of a short magnet brush and by uniforming the rise and fall in the axial direction of the sleeve, it is possible to prevent the density of the trailing edge of an image from decreasing even when the linear velocity ratio is increased (condition 1, FIG. 6), as determined by experiments. Therefore, an image forming apparatus capable of enhancing image quality by obviating local omission or jaggedness can be realized.

An electrophotographic color copier to which the illustrative embodiment is applied will be described with reference to FIG. 18. As shown, the color copier includes a color scanner or document reading device 11, a color printer or color image recording device 12, and a paper bank 13.

The color scanner 11 includes a lamp 102 for illuminating a document 10 laid on a glass platen 101. The resulting imagewise reflection from the document 10 is routed through a group of mirrors 103*a*, 103*b* and 103*c* and a lens 104 to a color sensor 105. The color sensor 105 reads color image information representative of the document 10 color by color to thereby output, e.g., R (red), G (green) and B (blue) electric color signals. In the illustrative embodiment, the color sensor 105 reads R, G and B color images derived from the image of the document 4 at the same time. An image processing section, not shown, converts the R, G and B color signals to Bk (black), C (cyan), M (magenta) and Y (yellow) color image data on the basis of the intensity levels of the R, G and B signals.

More specifically, to produce the Bk, C, M and Y color image data, optics including the lamp 102 and mirrors 103*a*–103*c* scans the document 10 in a direction indicated by an arrow in FIG. 1 in response to a scanner start signal synchronous to the operation of the color printer 12 which will be described later. The optics repeatedly scans the same document 10 four consecutive times in order to sequentially output color image data of four different colors. Every time the color printer 12 receives the color image data of one color, it produces a corresponding toner image. Finally, four toner images are superposed to complete a four-color or full-color image.

The color printer 12 includes a photoconductive drum or image carrier 20, an optical writing unit 22, a revolver or rotary developing device 23, an intermediate image transferring device 26, and a fixing device 27. The drum 20 is rotatable counterclockwise, as indicated by an arrow in FIG. 18. Arranged around the drum 20 are a drum cleaning device 201, a discharge lamp 202, a charger 203, a potential sensor 204, one of four developing sections included in the revolver 23, a density pattern sensor 205, and an intermediate transfer belt 261 included in the intermediate image transferring device 26. The revolver 23 has four developing sections, i.e., a Bk developing section 231K, an M developing section 231M, a C developing section 231C, and a Y developing section 231Y. In FIG. 18, the C developing section 231C is shown as facing the drum 20.

The optical writing unit 22 converts the color image data received from the scanner 11 to an optical signal and writes an image represented by the image data on the drum 20 with the optical signal, thereby electrostatically forming a latent image on the drum 20. For this purpose, the writing unit 22 includes a semiconductor laser 221, a laser drive controller, not shown, a polygonal mirror 222, a motor 223 for driving the mirror 222, an f/θ lens 224, and a mirror 225.

The revolver 23 including the four developing sections 231K, 231C, 231M and 231Y is bodily rotated by a driveline that will be described later. The developing sections 231K–231Y each include a developing sleeve rotatable with the head of a developer deposited thereon contacting the surface of the drum 20, and a paddle for scooping up and agitating the developer. The developer stored in each developing section is a mixture of toner of particular color and ferrite carrier. While the developer is agitated, the toner is charged to negative polarity due to friction acting between it and the carrier. A particular bias power source, not shown, is assigned to each developing sleeve and applies a bias for development to the sleeve, so that the sleeve is biased to a preselected potential relative to the metallic base of the drum 20. The bias is a negative DC voltage Vdc on which an AC voltage Vac is superposed.

While the copier is in a stand-by state, the revolver 23 is held stationary with its Bk developing section 231K facing the drum 20 at a preselected developing position. On the start of a copying operation, the color scanner 11 starts reading the document 10 at a preselected timing. Optical writing using a laser beam and the formation of a latent image begin on the basis of the resulting color image data. Let a latent image derived from Bk image data be referred to as a Bk latent image. This is also true with C, M and Y. To develop the Bk latent image from its leading edge, the Bk sleeve starts rotating before the leading edge of the Bk latent image arrives at the developing position. The Bk sleeve develops the Bk latent image with Bk toner. As soon as the trailing edge of the Bk latent image moves away from the developing position, the revolver 23 bodily rotates to bring the next developing section to the developing position. This rotation is completed at least before the leading edge of the next latent image arrives at the developing position. The construction and operation of the revolver 23 will be described more specifically later.

The intermediate image transferring device 26 includes the intermediate transfer belt 261, a belt cleaning device 262, and a corona discharger 263 for paper transfer. The belt 261 is passed over a drive roller 264*a*, a transfer counter roller 264*b*, a cleaning counter roller 264*c* and driven rollers (no numeral) and driven by a motor not shown. The belt cleaning device 262 includes an inlet seal, a rubber blade, an outlet coil, and a mechanism for moving the inlet seal and rubber blade into and out of contact with the belt 261. While the transfer of images of the second, third and fourth colors to the belt 261 is under way after the transfer of the Bk or first-color image, the above mechanism maintains the inlet seal and blade released from the belt 261. The corona discharger 263 is applied with an AC-biased DC voltage or a DC voltage in order to transfer the entire full-color image from the belt 261 to a paper or similar recording medium.

The color printer 12 includes a paper cassette 207 while the paper bank 13 includes paper cassettes 30*a*, 30*b* and 30*c*. The paper cassettes 207 and 30*a* through 30*c* each are loaded with a stack of papers of particular size. Pickup rollers 28 and 31*a* through 31*c* are respectively assigned to the paper cassettes 207 and 30*a* through 30*c*. Papers are fed from desired one of the cassettes 207 and 30*a* through 30*c* by associated one of the pickup rollers 28 and 31*a* through 31*c* toward a registration roller pair 29. A manual feed tray 21 is mounted on the right side of the printer 12, as viewed in FIG. 1, for allowing the operator to feed OHP (OverHead Projector) sheets, thick sheets or similar special sheets by hand.

In operation, at the beginning of an image forming cycle, the drum 20 and belt 261 are caused to rotate counterclockwise and clockwise, respectively. Bk, C, M and Y toner image are sequentially formed on the drum 20 and sequentially transferred form the drum 20 to the belt 261 one above the other, completing a full-color image on the belt 261.

Specifically, to form the Bk toner image, the charger 203 uniformly charges the drum 20 to about −700V. The semiconductor laser 221 scans the charged drum 20 in accordance with the Bk color image signal by raster scanning. In the portions of the drum 20 exposed by the laser 221, the charge is reduced by an amount proportional to the quantity of light with the result that the Bk latent image is formed. Negatively charged Bk toner deposited on the Bk developing sleeve contacts the Bk latent image and deposits only on the exposed portions of the drum 20 where the charge has been reduced. Consequently, a Bk toner image corresponding to the latent image is formed on the drum 20. The corona discharger 263 transfers the Bk toner image from the drum 20 to the belt 261 moving at the same speed as the drum 20 in contact with the drum 20. The transfer of a toner image from the drum 20 to the belt 261 will be referred to as belt transfer hereinafter.

After the belt transfer, the drum cleaning device 201 removes the toner left on the drum 20 in a small amount, thereby preparing the drum 20 for the next image forming cycle. The toner removed by the device 201 is collected in a waste toner tank via a piping although not shown specifically.

A C image forming step begins with the drum 20 after the above Bk image forming step. Specifically, the color scanner 1 starts reading C image data at a preselected timing. Laser writing using the resulting C image data forms a C latent image on the drum 20. After the trailing edge of the Bk latent image has moved away from the developing position, but before the leading edge of the C latent image arrives at the developing position, the revolver 23 is caused to rotate to bring the C developing unit 231C to the developing position. The C developing section 231C then develops the C latent image with C toner. As soon as the trailing edge of the C latent image moves away from the developing position, the revolver 23 is again rotated to bring the M developing section 231 to the developing position. This is also completed before the leading edge of the M latent image arrives at the developing position.

M and Y developing steps are similar to the Bk and C steps as to color image data reading, latent image formation and development and will not be described specifically in order to avoid redundancy.

The Bk, C, M and Y toner images are sequentially transferred from the drum 200 to the belt 261 one above the other so as to a full-color image on the belt 261. Subsequently, the corona discharger 263 transfers the entire full-color image from the belt 261 to a paper.

The paper is fed from any one of the previously stated paper cassettes or the manual feed tray and stopped by the registration roller 29. Thereafter, the registration roller 29 conveys the paper such that the leading edge of the paper meets the leading edge of the toner image carried on the belt 261 and reaching the corona discharger 263. The paper moves above the corona discharger 263 while being superposed on the toner image of the belt 261. At this instant, the corona discharger 263 charges the paper with a positive charge with the result that the full-color image is substantially entirely transferred to the paper. Subsequently, a corona discharger, not shown, located at the left-hand side of the corona discharger 263 and applied with an AC-biased DC voltage discharges the paper. As a result, the paper is separated from the belt 261 and transferred to a conveyor belt 211.

The conveyor belt 211 conveys the paper carrying the full-color image thereon to the fixing device 27 including a heat roller 271 controlled to a preselected temperature and a press roller 272. The heat roller 271 and press roller 272 pressed against the heat roller 271 fix the toner image on the paper with heat and pressure. Thereafter, the paper or full-color copy is driven out of the copier body to a copy tray, not shown, face up by an outlet roller pair 212.

After the belt transfer, the brush roller and rubber blade included in the drum cleaning device 201 clean the surface of the drum 20. The discharge lamp 202 uniformly discharges the cleaned surface of the drum 20. Also, the blade included in the belt cleaning device 262 is again pressed against the belt 261 in order to clean the surface of the belt 261 after the image transfer to the paper.

The revolver 23 will be described more specifically with reference to FIG. 19. As shown, the revolver 23 includes a hollow stay 242 having a rectangular cross-section and extending between a front and a rear end plate not shown.

The developing sections 231K through 231Y are supported by the stay 242 and respectively include casings 283K, 283C, 283M and 283Y identical in configuration with each other. The casings 283K through 283Y each store a developer of particular color, i.e., a mixture toner of particular color and carrier. The revolver 23 is shown as locating the Bk developing section 231K at the developing position and having the Bk developing section 231K, Y developing section 231Y, M developing section 231M and C developing section 231C sequentially arranged in this order in the counterclockwise direction, as viewed in FIG. 19.

Figure 19:
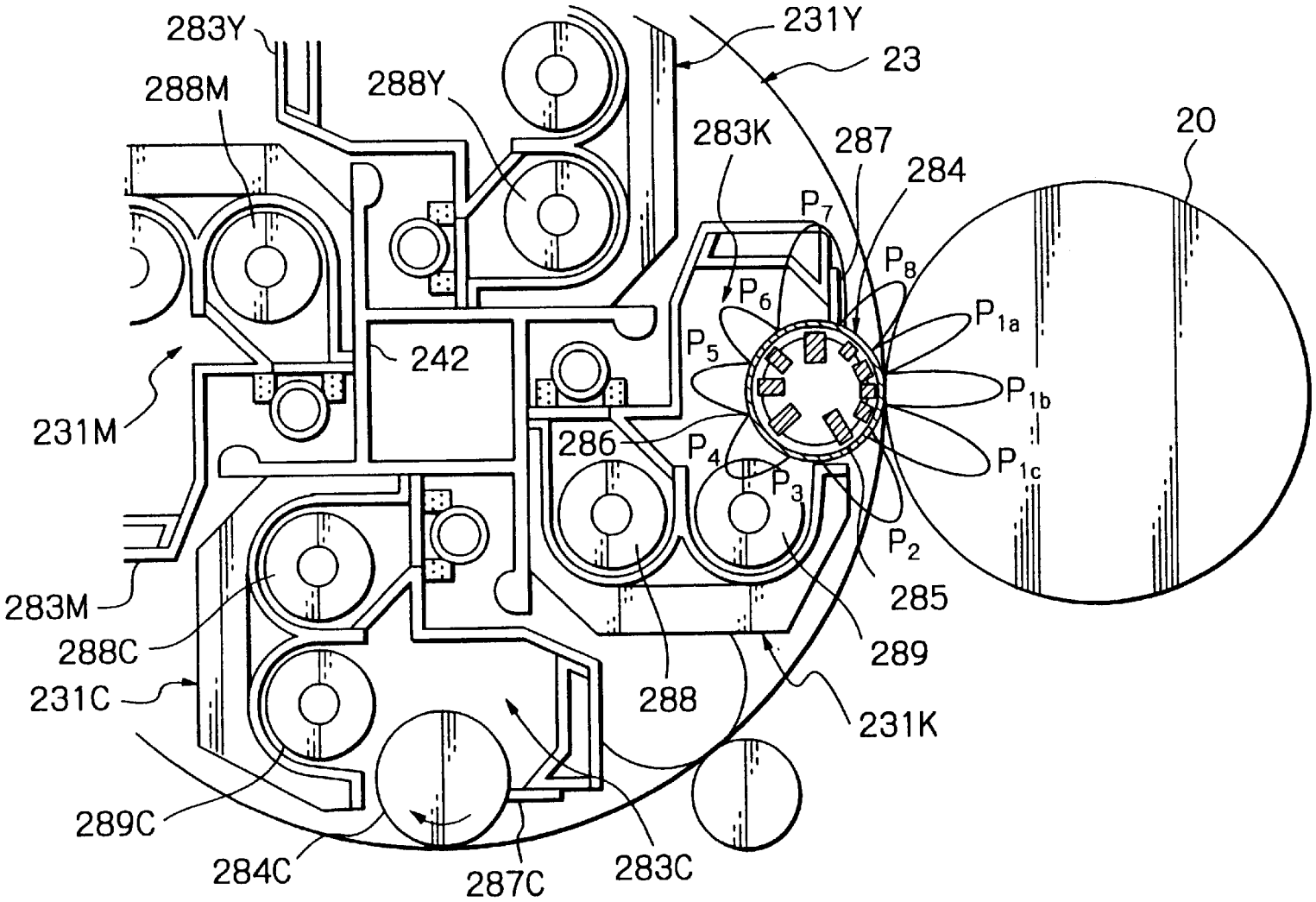
FIG. 19 is a fragmentary view of a revolver type developing unit included in the copier of FIG. 18.

Because the four developing sections 231K through 231C are identical in construction, the following description to be made with reference to FIG. 19 will concentrate on the Bk developing section 231K by way of example. The other developing sections are simply distinguished from the Bk developing section 231K by suffixes Y, M and C.

As shown in FIG. 19, a developing roller or developer carrier 284 adjoins the drum or image carrier 20 and forms a developing position between it and the drum 20. The developing roller 284 includes a sleeve 285 formed of aluminum, brass, conductive resin or similar nonmagnetic material and driven clockwise, as viewed in FIG. 19, by a drive mechanism not shown. In the illustrative embodiment, the drum 20 has a diameter of 90 mm and rotates at a linear velocity of 200 mm/sec. The sleeve 285 has a diameter of 30 mm and rotates at a linear velocity of 240 mm/sec. Therefore, the ratio of the linear velocity of the sleeve 285 to that of the drum 20 is 1.2. A gap of 0.4 mm for development is formed between the drum 20 and the sleeve 285.

A magnet roller 286 is fixed in place within the sleeve 285 for causing the developer deposited on the sleeve 285 to rise in the form of a head. Specifically, the carrier included in the developer rises in the form of a chain along magnetic lines of force generated by the magnet roller 286. The charged toner adheres to the chain-like carrier and forms a magnet brush. The sleeve 285 in rotation conveys the magnet brush in the direction in which it rotates (clockwise). The magnet roller 286 has a plurality of magnetic poles.

Figure 20:
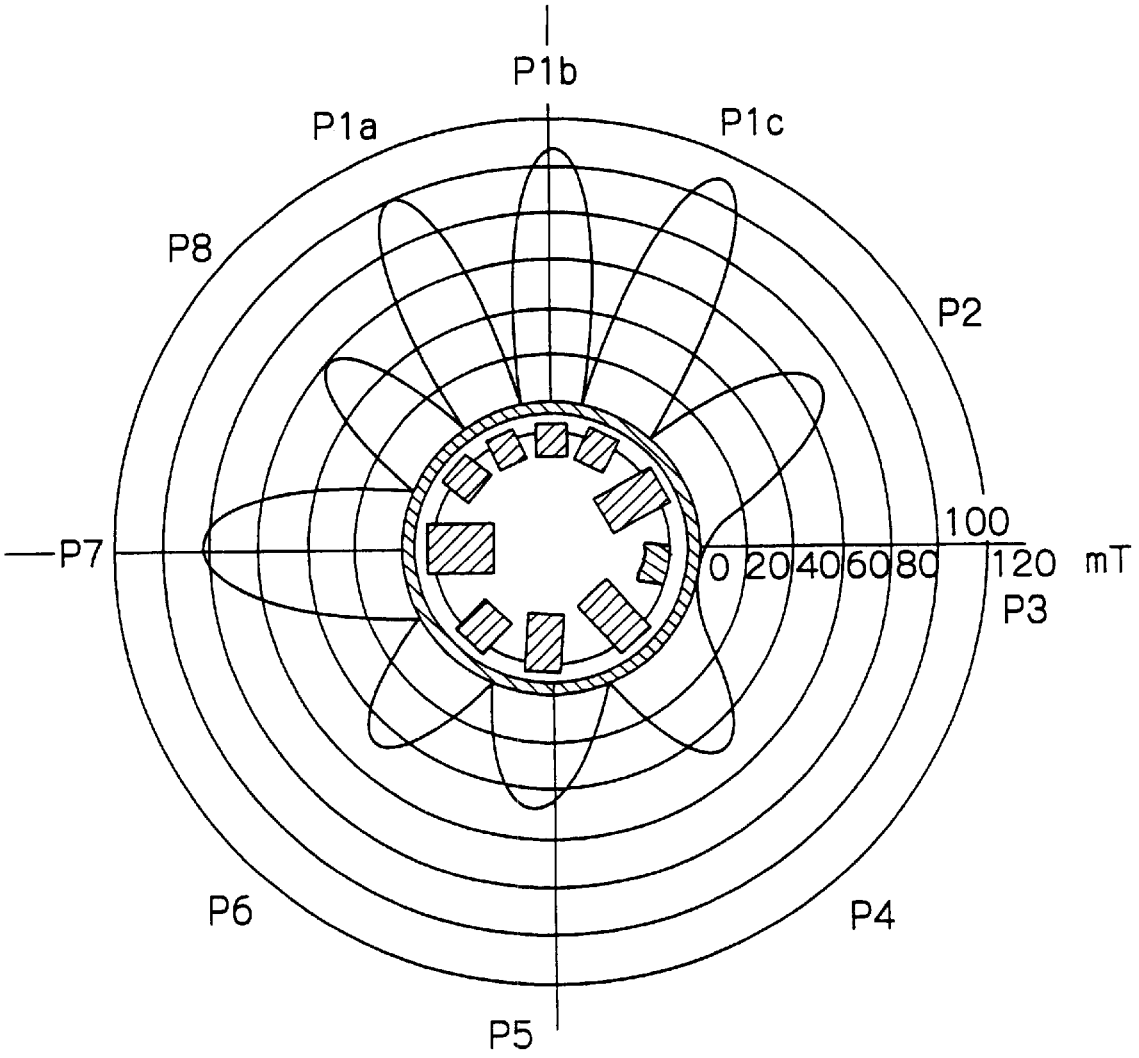
FIG. 20 is a circle chart showing the magnetic force distribution of a developing roller included in the developing unit of FIG. 19 and the sizes of magnetic forces.

Specifically, as shown in FIG. 20, a main magnet P1*b* causes the developer to rise in the form of a head in the developing region. Auxiliary magnets P1*a* and P1*c* help the main magnet P1B form a magnetic field. Magnets P4 and P5 cause the developer to deposit on the sleeve 285. Magnets P6, P7 and P8 serve to convey the developer deposited on the sleeve 285 to the developing region. Further, magnets P2 and P3 serve to convey the developer over a region following the developing region. The magnets P1*b* through P3 each are oriented in the radial direction of the sleeve 285.

FIG. 21 compares the FeNdB bond magnet roller of the illustrative embodiment and the conventional magnet roller with respect to flux density, half center angle, half-width, and magnetic pole. For measurement, the axial probe and gauss meter mentioned earlier were also used. A Hall element for measuring flux densities in the normal direction and tangential direction was spaced from the surface of the sleeve by 0.5 mm.

While the magnet roller 286 is shown as having ten magnets, additional magnets or magnetic poles may be arranged between the magnet P3 and the doctor blade in order to enhance the ability to scoop the developer and the ability to follow a black solid image. For example, twelve magnets may be arranged in total. While the individual magnet of the magnet roller 286 may have a square cross-section, it may alternatively have a sectorial, annular or similar cross-section.

A doctor blade 287 is also disposed in the casing 283K for regulating the amount of the developer to be conveyed by the developing roller 284 toward the drum 20. A first conveyor screw 288 conveys part of the developer scraped off by the doctor blade 287 from the rear to the front in the axial direction. A second conveyor screw 289 is identical with the first conveyor screw 288 except that it conveys the above part of the developer from the front to the rear. A toner content sensor is positioned in the casing 283K below the second screw 289 for sensing the toner content of the developer stored in the casing 283K.

In summary, in accordance with the present invention, the rise and fall of a short magnet brush are realized and allow a nip for development to be reduced. This, coupled with the fact that the short magnet brush rises and falls uniformly in the axial direction of a sleeve, frees the trailing edge of an image from local omission or jaggedness while reducing defective images including a thinned dot image. The present invention therefore allows image density to be increased and develops even a low contrast image in a desirable manner.

Various modifications will become possible for those skilled in the art after receiving the teachings of the present disclosure without departing from the scope thereof.

What is claimed is:

1. In a method of developing a latent image electrostatically formed on an image carrier by causing a developer to deposit on a developing sleeve in a form of a magnet brush, formed by a main magnetic pole, and contact said image carrier, said magnet brush uniformly rises in a form of a head in an axial direction of said developing sleeve and contacts said image carrier.

2. In a method of developing a latent image electrostatically formed on an image carrier by causing a developer to deposit on a developing sleeve in a form of a magnet brush, formed by a main magnetic pole, and contact said image carrier, said magnet brush is uniformly released from said image carrier in an axial direction of said developing sleeve and falls down.

3. In a method of developing a latent image electrostatically formed on an image carrier by causing a developer to deposit on a developing sleeve in a form of a magnet brush, formed by a main magnetic pole, and contact said image carrier, an auxiliary magnet having an auxiliary magnetic pole is formed for helping a main magnetic pole, which causes said developer to rise, form a magnetic force;

wherein said auxiliary magnet comprises at least one of two auxiliary magnets respectively positioned upstream and downstream of a main magnet forming said main magnetic pole in a direction in which the developer is conveyed; and wherein a center angle between said main magnet and said at least one auxiliary magnet is 30° or less.

4. A method as claimed in claim 3, wherein said auxiliary magnetic pole comprises at least one of two auxiliary magnetic poles respectively intervening between said main magnetic pole and magnetic poles for conveyance located upstream and downstream of said main magnetic pole in a direction in which the developer is conveyed.

5. In a developing device for developing a latent image electrostatically formed on an image carrier by causing a developer to deposit on a developing sleeve in a form of a magnet brush, formed by a main magnetic pole, and contact said image carrier, said magnet brush uniformly rises in a form of a head in an axial direction of said developing sleeve and contacts said image carrier.

6. In a developing device for developing a latent image electrostatically formed on an image carrier by causing a developer to deposit on a developing sleeve in a form of a magnet brush, formed by a main magnetic pole, and contact said image carrier, said magnet brush is uniformly released from said image carrier in an axial direction of said developing sleeve and falls down.

7. In a developing device including a developer carrier made up of a nonmagnetic sleeve and a magnet roller fixed in place within said nonmagnetic sleeve and having a magnet for scooping up a developer, a magnetic pole for conveying said developer and a main magnetic pole for causing said developer to rise in a form of a head, a flux density in a direction normal to said main magnetic pole has an attenuation ratio of 40% or above.

8. A developing device as claimed in claim 7, wherein a magnet forming said main magnet pole is formed of a rare-earth metal alloy.

9. In a developing device including a developer carrier made up of a nonmagnetic, sleeve and a magnet roller fixed in place within said nonmagnetic sleeve and having a magnet for scooping up a developer, a magnetic pole for conveying said developer and a main magnetic pole for causing said developer to rise in a form of a head, said main magnetic pole has a half-width of 22° or less.

10. In a developing device including a developer carrier made up of a nonmagnetic sleeve and a magnet roller fixed in place within said nonmagnetic sleeve and having a magnet for scooping up a developer, a magnetic pole for conveying said developer and a main magnetic pole for causing said developer to rise in a form of a head, said magnet roller includes an auxiliary magnet for helping said main magnetic pole from a magnetic force, wherein said auxiliary magnet comprises at least one of two auxiliary magnets respectively positioned upstream and downstream of a main magnet forming said main magnetic pole in a direction in which the developer is conveyed; and wherein a center angle between said main magnet and said at least one auxiliary magnet is 30° or less.

11. A developing device as claimed in claim 10, wherein said main magnetic pole and said at least one auxiliary magnet are different in polarity from each other.

12. A developing device as claimed in claim 11, wherein said main magnet is formed of a rare-earth metal alloy.

13. A developing device as claimed in claim 10, wherein said main magnet is formed of a rare-earth metal alloy.

14. A developing device as claimed in claim 10, wherein said at least one auxiliary magnet has a half-width of 35° or less.

15. A developing device as claimed in claim 14, wherein said main magnetic pole and said at least one auxiliary magnet are different in polarity from each other.

16. A developing device as claimed in claim 15, wherein said main magnet is formed of a rare-earth metal alloy.

17. A developing device as claimed in claim 14, wherein said main magnet is formed of a rare-earth metal alloy.

18. A developing device as claimed in claim 10, wherein said magnet roller comprises two auxiliary magnets and two magnets respectively positioned outward of said two auxiliary magnets for forming magnetic poles for conveyance, polarity transition points between said two auxiliary magnets and said two magnets adjoining said two auxiliary magnets forming a center angle of said magnet roller of 120° or less.

19. A developing device as claimed in claim 18, wherein said main magnetic pole and said at least one auxiliary magnet are different in polarity from each other.

20. A developing device as claimed in claim 19, wherein said main magnet is formed of a rare-earth metal alloy.

21. A developing device as claimed in claim 18, wherein said main magnet is formed of a rare-earth metal alloy.

22. A developing device as claimed in claim 10, wherein said main magnetic pole and said at least one auxiliary magnet are different in polarity from each other.

23. A developing device as claimed in claim 22, wherein said main magnet is formed of a rare-earth metal alloy.

24. A developing device as claimed in claim 10, wherein said main magnet is formed of a rare-earth metal alloy.

25. A developing device as claimed in claim 10, wherein said at least one auxiliary magnet has a half-width of 35° or less.

26. A developing device as claimed in claim 25, wherein said main magnetic pole and said at least one auxiliary magnet are different in polarity from each other.

27. A developing device as claimed in claim 25, wherein said main magnet is formed of a rare-earth metal alloy.

28. A developing device as claimed in claim 10, wherein said main magnetic pole and said at least one auxiliary magnet are different in polarity from each other.

29. A developing device as claimed in claim 28, wherein said main magnet is formed of a rare-earth metal alloy.

30. A developing device as claimed in claim 10, wherein a main magnet forming said main magnetic pole is formed of a rare-earth metal alloy.

31. In a magnet roller constituting a developer carrier mounted on a developing device, and including a main magnetic pole for causing a developer to rise in a form of a head, a flux density in a direction normal to said main magnetic pole has an attenuation ratio of 40% or above.

32. A magnet roller as claimed in claim 31, wherein a magnet forming said main magnetic pole is formed of a rare-earth metal alloy.

33. In a magnet roller constituting a developer carrier mounted on a developing device, and including a main magnetic pole for causing a developer to rise in a form of a head, said main magnetic pole has a half-width of 22° or less.

34. In a magnet roller constituting a developer carrier mounted on a developing device, an auxiliary magnet helps a main magnetic pole form a magnetic force for causing a developer to rise in a form of a head in a preselected developing region, wherein said auxiliary magnet comprises at least one of two auxiliary magnets respectively positioned upstream and downstream of a main magnet forming said main magnetic pole in a direction in which the developer is conveyed; and wherein a center angle between said main magnet and said at least one auxiliary magnet is 30° or less.

35. A magnet roller as claimed in claim 34, wherein said main magnetic pole and said at least one auxiliary magnet are different in polarity from each other.

36. A magnet roller as claimed in claim 35, wherein at least said main magnet is formed of a rare-earth metal alloy.

37. A magnet roller as claimed in claim 34, wherein said main magnet is formed of a rare-earth metal alloy.

38. A magnet roller as claimed in claim 34, wherein said at least one auxiliary magnet has a half-width of 35° or less.

39. A magnet roller as claimed in claim 38, wherein said main magnetic pole and said at least one auxiliary magnet are different in polarity from each other.

40. A magnet roller as claimed in claim 39, wherein at least said main magnet is formed of a rare-earth metal alloy.

41. A magnet roller as claimed in claim 38, wherein at least said main magnet is formed of a rare-earth metal alloy.

42. A magnet roller as claimed in claim 34, wherein said magnet roller comprises two auxiliary magnets and two magnets respectively positioned outward of said two auxiliary magnets for forming magnetic poles for conveyance, polarity transition points between said two auxiliary magnets and said two magnets adjoining said two auxiliary magnets forming a center angle of said magnet roller of 120° or less.

43. A magnet roller as claimed in claim 42, wherein said main magnetic pole and said at least one auxiliary magnet are different in polarity from each other.

44. A magnet roller as claimed in claim 43, wherein at least said main magnet is formed of a rare-earth metal alloy.

45. A magnet roller as claimed in claim 42, wherein at least said main magnet is formed of a rare-earth metal alloy.

46. A magnet roller as claimed in claim 34, wherein said main magnetic pole and said at least one auxiliary magnet are different in polarity from each other.

47. A magnet roller as claimed in claim 46, wherein at least said main magnet is formed of a rare-earth metal alloy.

48. A magnet roller as claimed in claim 34, wherein at least said main magnet is formed of a rare-earth metal alloy.

49. A magnet roller as claimed in claim 34, wherein said at least one auxiliary magnet has a half-width of 35° or less.

50. A magnet roller as claimed in claim 49, wherein said main magnetic pole and said at least one auxiliary magnet are different in polarity from each other.

51. A magnet roller as claimed in claim 50, wherein at least said main magnet is formed of a rare-earth metal alloy.

52. A magnet roller as claimed in claim 49, wherein at least said main magnet is formed of a rare-earth metal alloy.

53. A magnet roller as claimed in claim 34, wherein said main magnetic pole and said at least one auxiliary magnet are different in polarity from each other.

54. A magnet roller as claimed in claim 53, wherein at least said main magnet is formed of a rare-earth metal alloy.

55. A developing device as claimed in claim 34, wherein at least said main magnet is formed of a rare-earth metal alloy.

56. In an image forming apparatus including a developing device for developing a latent image electrostatically formed on an image carrier by causing a developer to deposit on a developing sleeve in a form of a magnet brush, formed by a main magnetic pole, and contact said image carrier, said magnet brush uniformly rises in a form of a head in an axial direction of said developing sleeve and contacts said image carrier.

57. In an image forming apparatus including a developing device for developing a latent image electrostatically formed on an image carrier by causing a developer to deposit on a developing sleeve in a form of a magnet brush, formed by a main magnetic pole, and contact said image carrier, said magnet brush is uniformly released from said image carrier in an axial direction of said developing sleeve and falls down.

58. In an image forming apparatus including a developing device including a developer carrier made up of a nonmagnetic sleeve and a magnet roller fixed in place within said nonmagnetic sleeve and having a magnet for scooping up a developer, a magnetic pole for conveying said developer, and a main magnetic pole for causing said developer to rise in a form of a head, a flux density in a direction normal to said main magnetic pole has an attenuation ratio of 40% or above.

59. In an image forming apparatus including a developing device including a developer carrier made up of a nonmagnetic sleeve and a magnet roller fixed in place within said nonmagnetic sleeve and having a magnet for scooping up a developer, a magnetic pole for conveying said developer, and a main magnetic pole for causing said developer to rise in a form of a head, said main magnetic pole has a half-width of 22° or less.

60. In an image forming apparatus including a developing device including a developer carrier made up of a nonmagnetic sleeve and a magnet roller fixed in place within said nonmagnetic sleeve and having a magnet for scooping up a developer, a magnetic pole for conveying said developer, and a main magnetic pole for causing said developer to rise in a form of a head said magnet roller includes an auxiliary magnet for helping said main magnetic pole form a magnetic force, wherein said auxiliary magnet comprises at least one of two auxiliary magnets respectively positioned upstream and downstream of a main magnet forming said main magnetic pole in a direction in which the developer is conveyed; and wherein a center angle between said main magnet and said at least one auxiliary magnet is 30° or less.

* * * * *